US007603057B2

(12) United States Patent
Shiraki et al.

(10) Patent No.: US 7,603,057 B2
(45) Date of Patent: Oct. 13, 2009

(54) PHOTOSENSITIVE UNIT AND DEVELOPER CARTRIDGE

(75) Inventors: Masatoshi Shiraki, Nisshin (JP); Yasushi Okabe, Chikusa-ku (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 207 days.

(21) Appl. No.: 11/755,110

(22) Filed: May 30, 2007

(65) Prior Publication Data

US 2007/0280733 A1 Dec. 6, 2007

(30) Foreign Application Priority Data

May 30, 2006 (JP) ..... 2006-150669

(51) Int. Cl.
*G03G 21/18* (2006.01)
*G03G 15/08* (2006.01)

(52) U.S. Cl. ..... 399/113; 399/111; 399/120

(58) Field of Classification Search ..... 399/113, 399/111, 110, 119, 120
See application file for complete search history.

(56) References Cited

U.S. PATENT DOCUMENTS 6,708,011 B2 3/2004 Nomura et al.
6,714,751 B2 * 3/2004 Higeta et al. ..... 399/113
2002/0071693 A1 * 6/2002 Shimaoka ..... 399/113
2006/0159487 A1 * 7/2006 Choi et al. ..... 399/113
2006/0245784 A1 * 11/2006 Tsuzuki et al. ..... 399/111
2007/0217818 A1 * 9/2007 Shiraki et al. ..... 399/111
2007/0223962 A1 * 9/2007 Shiraki ..... 399/111

FOREIGN PATENT DOCUMENTS

JP 07-295460 A * 11/1995
JP 2001-042622 A * 2/2001
JP 2003015378 1/2003

OTHER PUBLICATIONS

Machine translation of JP 07-295460 A dated Mar. 4, 2009.*
Machine translation of JP 2001-042622 A dated Mar. 4, 2009.*

* cited by examiner

*Primary Examiner*—Sophia S Chen
(74) *Attorney, Agent, or Firm*—Banner & Witcoff, LTD.

(57) ABSTRACT

A photosensitive unit is described. A photosensitive unit may include a developer cartridge including a developing agent carrier and a casing for supporting the developer carrier; a photosensitive body disposed so that the developing agent carrier is brought into contact therewith by pressing; and a cartridge attaching portion to which the developer cartridge is detachably attached. The casing includes an elastic member, a pressing member for pressing the elastic member so that the developing agent carrier is pressed toward the photosensitive body, and a fitting member provided on the pressing member. The cartridge attaching portion includes a fit portion which is fitted by the fitting member so that the pressing member presses the elastic member toward the developing agent carrier for maintaining the pressing state of the pressing member to the elastic member by the fitting.

32 Claims, 20 Drawing Sheets

PHOTOSENSITIVE UNIT AND DEVELOPER CARTRIDGE

CROSS-REFERENCE TO RELATED APPLICATION

This application claims priority benefits on the basis of Japanese Patent Application No. 2006-150669, filed on May 30, 2006, the disclosure of which is herein incorporated by reference in its entirety.

TECHNICAL FIELD

Aspects of the present invention relate to a photosensitive unit equipped in an image forming apparatus such as a laser printer and to a developer cartridge attached to the photosensitive unit.

BACKGROUND

Conventionally, a so-called tandem type image forming apparatus in which photosensitive bodies corresponding to respective colors of yellow, magenta, cyan, and black are disposed in parallel in a horizontal direction has been known.

In this tandem type image forming apparatus, respective color toner images are formed on the corresponding photosensitive bodies generally at the same time, and are sequentially transferred from the photosensitive bodies to the sheet which sequentially passes each photosensitive body, so that the color image can be formed generally at the same speed as in the black and white image forming apparatus.

As such a tandem type image forming apparatus, for example, an image forming apparatus, in which four photosensitive bodies, a corona charger arranged around each of the photosensitive bodies, and a cleaning device are provided as a integral photosensitive cartridge, and it can be attached to and detached from the apparatus main body, and further, the developing unit which is an attachment to the photosensitive body is also detachably attachable to the photosensitive cartridge, has been proposed.

In this image forming apparatus, a black developing unit, and a cyan-magenta-yellow developing unit are detachably and replaceably attached to the photosensitive cartridge. When each developing unit is attached to the photosensitive cartridge, a fixed lever provided to the photosensitive cartridge pivots to fix the developing unit to the photosensitive cartridge.

Moreover, in an image forming apparatus, the developing unit described below has been also known. The developing unit is provided with a developing roller for feeding a toner to the photosensitive body. When the developing unit is attached to the photosensitive cartridge, an elastic member such as a spring provided to the photosensitive cartridge presses the developing unit, and in turn the developing roller is pressed to the photosensitive body with a predetermined pressing force.

However, the pressing force of the elastic member applied to the developing unit is gradually reduced by degradation of the elastic member with time. Accordingly, the pressing force of the developing roller to the photosensitive body is reduced, and then the toner supply from the developing roller to the photosensitive body is reduced, which may degrade the development quality.

SUMMARY

It is therefore an object of the present invention to provide a photosensitive unit which can stabilize the pressing force of the developing agent carrier to the photosensitive body and thus can secure stable development, and to provide a developer cartridge attached to the photosensitive unit.

One aspect of the present invention may provide a photosensitive unit comprising: a developer cartridge comprising a developing agent carrier carrying a developing agent and a casing supporting the developing agent carrier and accommodating the developing agent; a photosensitive body disposed so that the developing agent carrier is brought into contact therewith by pressing and developed with an electrostatic latent image by the developing agent fed from the developer carrier; and a cartridge attaching portion to which the developer cartridge is detachably attached, wherein the casing comprises an elastic member, a pressing member for pressing the elastic member toward the developing agent carrier so that the developing agent carrier is pressed toward the photosensitive body, and a fitting member provided on the pressing member, and the cartridge attaching portion comprises a fit portion which is fitted with the fitting member so that the pressing member presses the elastic member toward the developing agent carrier for maintaining a pressing state of the pressing member to the elastic member by this fitting.

The same or different aspect of the present invention may provide a developer cartridge detachably attachable to a photosensitive unit having a photosensitive body, comprising: a developing agent carrier for carrying a developing agent which is fed to the photosensitive body; a casing supporting the developing agent carrier and accommodating a developing agent; an elastic member provided in the casing; a pressing member provided in the casing for pressing the elastic member toward the developing agent carrier so that the developing agent carrier is pressed toward the photosensitive body; and a fitting member provided on the pressing member, fitted to the photosensitive unit so that the pressing member presses the elastic member toward the developing agent carrier, and maintaining a pressing state of the pressing member to the elastic member by this fitting.

One or more aspects of the present invention is to provide a developer cartridge comprising: a casing for accommodating a developing agent; a developing agent carrier provided on one end portion in the casing for carrying the developing agent; an elastic member provided on the other end portion which is opposite to the one end portion in the casing; a pressing member provided on the other end portion in the casing for pressing the elastic member toward the developing agent carrier; and a fitting member provided on the pressing member so as to protrude outward in an axial direction of the developing agent carrier and fitted to an other member to maintain a pressing state of the pressing member to the elastic member.

One or more aspects of the present invention is to provide a developer cartridge comprising: a developing roller carrying a developing agent; a developer frame accommodating the developing agent, formed with an opening on one end side, and rotatably supporting the developing roller in the vicinity of the opening; an elastic member provided on other end side in the developer frame; a grip provided to be pivotable between a position where the elastic member is pressed and a position where the elastic member is not pressed with a portion of the developer frame as a spindle, wherein the grip comprises a pressing plate which can be opposed to the other end side of the developer frame, a supporting plate extending from both end edges of the pressing plate in a longitudinal direction of the developing roller toward the one end side, and a projection protruding from outside surface in a longitudinal direction of the developing roller in the vicinity of the one end side of the supporting plate.

One or more aspects of the present invention is to provide a developer cartridge comprising: a developing roller carrying a developing agent; a developer frame accommodating the developing agent, formed with an opening on one end side, and rotatably supporting the developing roller in the vicinity of the opening; and a grip provided on other end side in the developer frame, wherein the grip comprises a pressing plate which can be opposed to the other end side of the developer frame, a supporting plate extending from both end edges of the pressing plate in a longitudinal direction of the developing roller toward the one end side, a projection protruding from an outside surface in a longitudinal direction of the developing roller in the vicinity of the one end side of the supporting plate, and an elastic member formed in the pressing plate so that the elastic member can be opposed to the other end side of the developer frame, and the grip is provided to be pivotable between a position where the elastic member presses the other end side of the developer frame and a position where the elastic member does not press the other end side of the developer frame with a portion of the developer frame as a spindle.

One or more aspects of the present invention is to provide a developer cartridge comprising: a developing roller carrying a developing agent; a developer frame accommodating the developing agent, formed with an opening on one end side, and rotatably supporting the developing roller in the vicinity of the opening; and a grip provided on other end side in the developer frame to be pivotable between a position close to the other end side of the developer frame and a position spaced from the other end side of the developer frame with a portion of the developer frame as a spindle, wherein the grip comprises a pressing plate which can be opposed to the other end side of the developer frame, an elastic member extending from both end edges of the pressing plate in a longitudinal direction of the developing roller toward the one end side, and a projection protruding outward in a longitudinal direction of the developing roller in the vicinity of the one end side of the elastic member.

DETAILED DESCRIPTION

FIRST EMBODIMENT

1. Overall Configuration of Color Laser Printer

Figure 1:
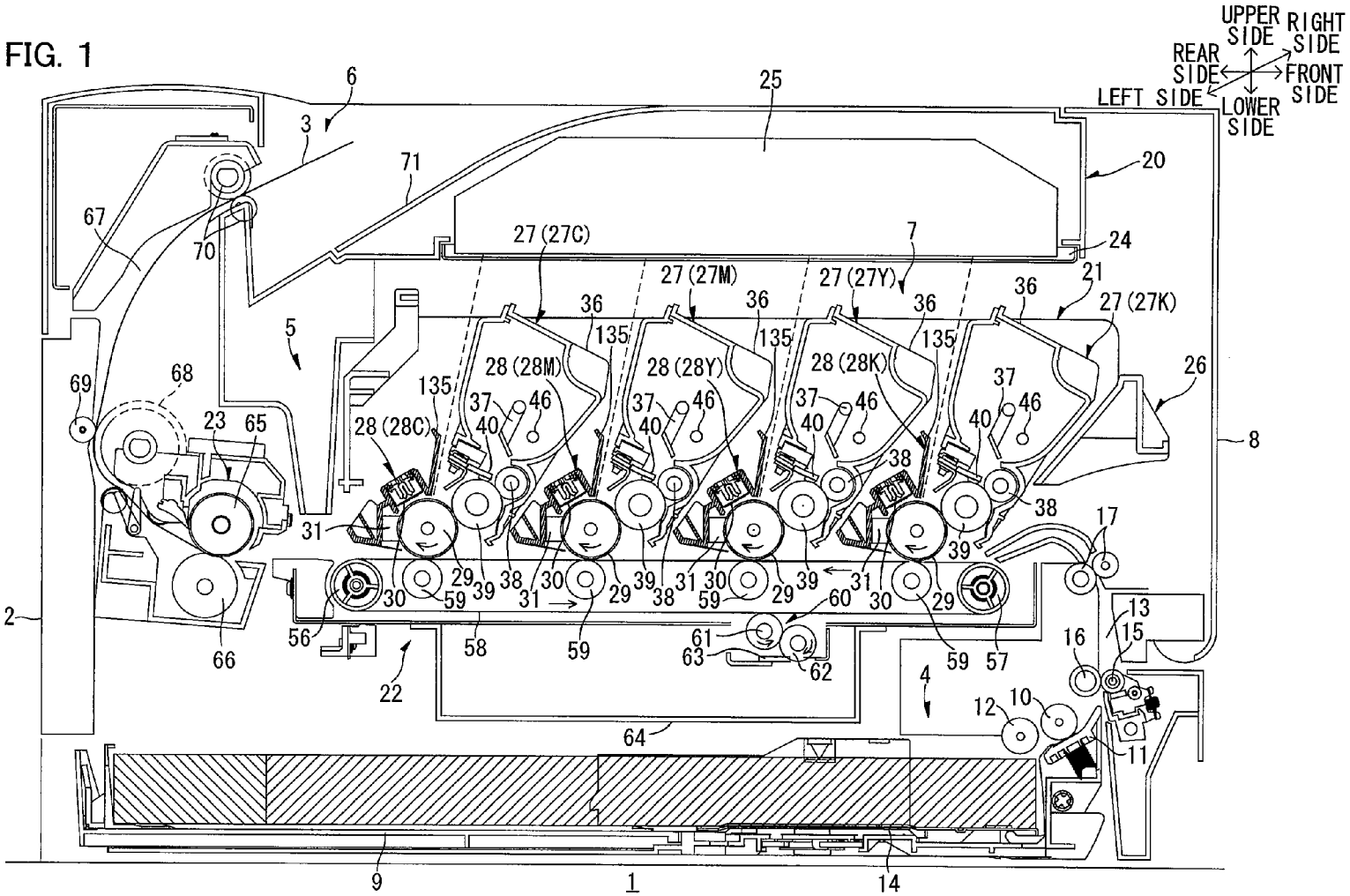
FIG. 1 is a sectional side view showing illustrative aspects of a color laser printer as an image forming apparatus.
Figure 2:
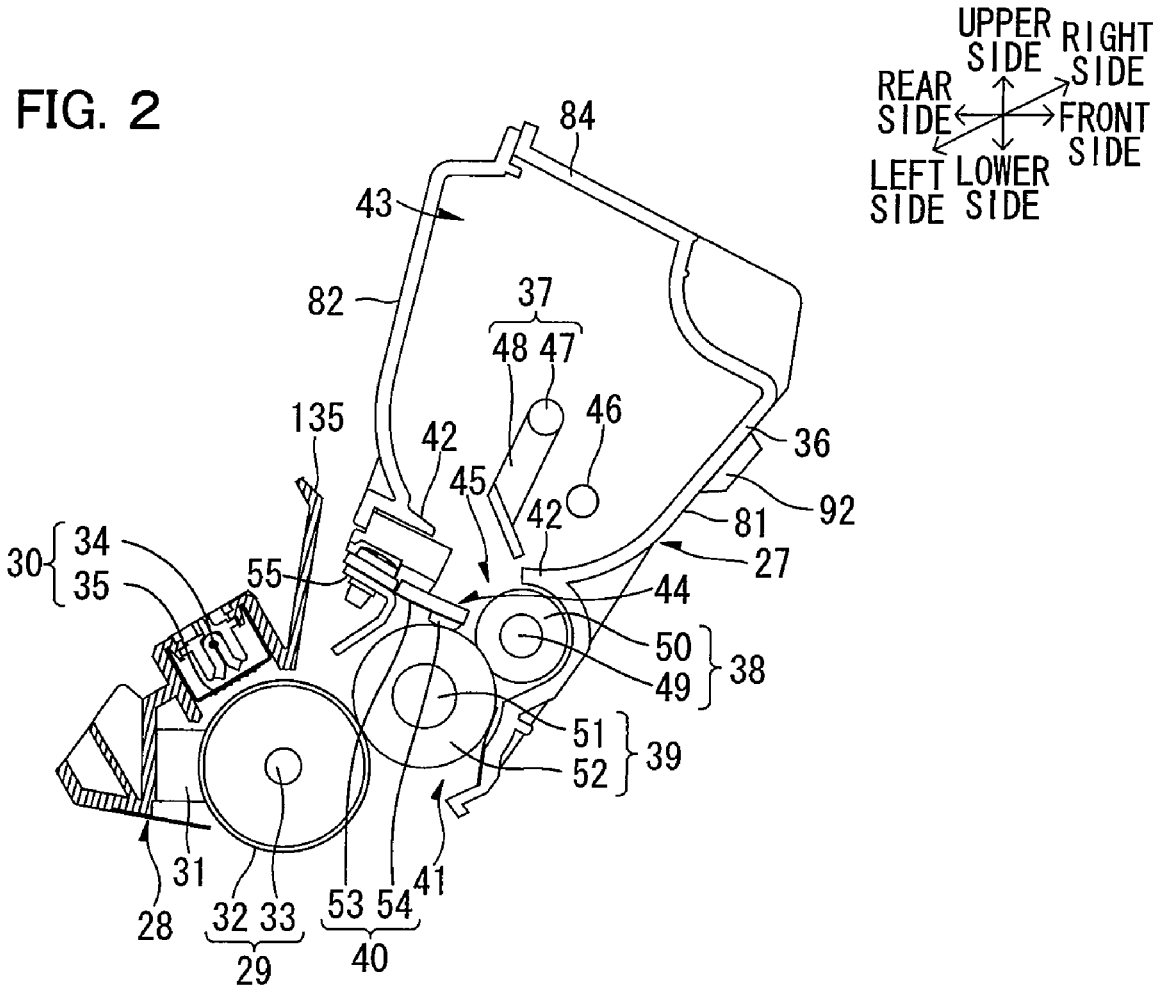
FIG. 2 is a sectional view showing a main portion of a drum subunit to which a developer cartridge is attached in the color laser printer shown in FIG. 1.

FIG. 1 is a sectional side view showing an embodiment of a color laser printer as an image forming apparatus. FIG. 2 is a sectional view showing a main portion of a drum subunit to which a developer cartridge is attached in the color laser printer shown in FIG. 1. A grip 103 described later is not shown in FIGS. 1 and 2.

This color laser printer 1 is a horizontal tandem type color laser printer in which a plurality of drum subunits 28 described later are disposed in parallel in the horizontal direction, and includes, in a main body casing 2, a sheet feeding section 4 for feeding a sheet 3, an image forming section 5 for forming an image on the fed sheet 3, and a sheet ejecting section 6 for ejecting the sheet 3 which is formed with an image.

(1) Main Body Casing

The main body casing 2 is formed in a generally rectangular box shape as seen from the side and formed with a drum receiving space 7 therein for receiving a drum unit 26 which is described later.

The main body casing 2 is provided with a front cover 8 on one side (front side) surface thereof. This front cover 8 is inclined forward from the main body casing 2 to open the drum accommodation space 7 and stands along the front surface of the main body casing 2 to close the drum accommodation space 7. When the drum accommodation space 7 is opened, the drum unit 26 can be attached to and detached from the drum receiving space 7.

In the following description, the side on which the front cover 8 is provided (right side in FIG. 1) is referred to a "front side" while the opposite side thereof (left side in FIG. 1) is referred to a "rear side". Moreover, the right and left sides are defined in the state where this color laser printer 1 is seen from the front side. As for the drum unit 26 and a developer cartridge 27, the left and right sides, the front and rear sides, and the upper and lower sides are defined with reference to the state where the drum unit 26 and the developer cartridge 27 are attached in the main body casing 2, unless otherwise specified.

(2) Sheet Feeding Section

The sheet feeding section 4 includes, on the bottom portion of the main body casing 2, a sheet feeding tray 9 in which the sheet 3 is accommodated in a stacked manner, a separation roller 10 and a separation pad 11 provided in an opposed relation to each other above the front end portion of the sheet feeding tray 9, a sheet feeding roller 12 provided in back of the separation roller 10, and a sheet feeding transport path 13 through which the sheet 3 passes.

The sheet feeding tray 9 can be slidably attached to and detached from the main body casing 2 on the front side in the anteroposterior direction and provided therein with a sheet pressing plate 14 on which the sheets 3 are placed in stacked manner. The uppermost sheet 3 on the sheet pressing plate 14 is pressed by the sheet feeding roller 12 and fed between the separation roller 10 and the separation pad 11 by the rotation of the sheet feeding roller 12.

The sheet 3 thus fed is sandwiched between the separation roller 10 and the separation pad 11 by the rotation of the separation roller 10, separated one by one, and transported toward the sheet feeding transport path 13.

The sheet 3 transported to the sheet feeding transport path 13 is transported along the sheet feeding transport path 13, passes between the paper dust removing roller 15 and the pinch roller 16, and after the paper dust is removed, transported toward the regist rollers 17.

The regist rollers 17 resist the sheet 3 and then transport the sheet 3 toward the transport belt 58.

(3) Image Forming Section

The image forming section 5 includes a scanning section 20, a processing section 21, a transferring section 22, and a fixing section 23.

(3-1) Scanning Section

The scanning section 20 is disposed in the upper portion of the main body casing 2. This scanning section 20 includes a scanning unit 25, and a scanner casing 24 fixed to the upper portion of the main body casing 2 and accommodates the scanning unit 25.

The scanning unit 25 is provided therein with, for example, optical elements such as four light sources, a polygonal mirror, an fθ lens, a reflection mirror, and a face tangle error correction lens. Each light source emits laser beams based upon image data. The emitted beams are deflected and scanned at the polygonal mirror, passes the fθ lens and the face tangle error correction lens, reflected by the reflection mirror, and irradiated by high speed scanning on the surface of a photosensitive drum 29 of each color described later.

(3-2) Processing Section

The processing section 21 is disposed below the scanning section 20 and above the sheet feeding section 4, and includes the drum unit 26 as an example of a single photosensitive unit, and four developer cartridges 27 corresponding to respective colors.

(3-2-1) Drum Unit

The drum unit 26 includes the four drum subunits 28 as an example of cartridge attaching portions corresponding to respective colors. Specifically, the drum subunits 28 consists of a black drum subunit 28K, a yellow drum subunit 28Y, a magenta drum subunit 28M, and a cyan drum subunit 28C.

The drum subunits 28 are disposed in a spaced parallel relation to each other in the anteroposterior direction. More specifically, a black drum subunit 28K, a yellow drum subunit 28Y, a magenta drum subunit 28M and a cyan drum subunit 28C are disposed in this order from the front side to the rear side.

As described later, each drum subunit 28 which is described later includes a pair of side frames 134 and a center frame 135 extending therebetween (see FIG. 12).

Each drum subunit 28 includes the photosensitive drum 29 as an example of a photosensitive body, a scorotron charger 30, and a cleaning brush 31, as shown in FIG. 2.

The photosensitive drum 29 includes a drum body 32 and a drum shaft 33 which rotatably supports the drum body 32.

The drum body 32 is formed in a cylindrical shape and disposed along the left-and-right direction, and the outermost surface layer thereof has a positively chargeable photosensitive layer formed of polycarbonate.

The drum shaft 33 is disposed along the axial direction of the drum body 32. The axial both end portions thereof are respectively inserted through the pair of side frames 134 (see FIG. 12) and fixed to later described side plates 133 (see FIG. 13) so as not to be relatively rotatable.

The photosensitive drum 29 is rotated at the time of image formation by a driving force from a motor (not shown) provided in the main body casing 2.

The scorotron charger 30 is disposed in an opposed spaced relation to the photosensitive drum 29 on obliquely upper rear side of the photosensitive drum 29 and supported by the center frame 135.

This scorotron charger 30 includes a discharge wire 34 and a grid 35 provided between the discharge wire 34 and the photosensitive drum 29.

At the time of image formation, the discharge wire 34 is applied with a high voltage to generate corona discharge, and at the same time a grid voltage is applied to the grid 35 to control the amount of the charge supplied to the photosensitive drum 29. As a result, the surface of the photosensitive drum 29 is positively and uniformly charged.

The cleaning brush 31 is opposed to and contact with the photosensitive drum 29 in back of the photosensitive drum 29 and supported on the center frame 135. The cleaning brush 31 is applied with a cleaning bias at the time of image formation.

(3-2-2) Developer Cartridge

The developer cartridge 27 is provided so as to be detachably attached to the corresponding drum subunit 28 for the corresponding color, as shown in FIG. 1.

That is, the developer cartridges 27 include a black developer cartridge 27K which is detachably attached to the black drum subunit 28K, a yellow developer cartridge 27Y which is detachably attached to the yellow drum subunit 28Y, a magenta developer cartridge 27M which is detachably attached to the magenta drum subunit 28M, and a cyan developer cartridge 27C which is detachably attached to the cyan drum subunit 28C.

Each developer cartridge 27 is provided with a developer frame 36 as an example of a casing, and is provided with an agitator 37, a feed roller 38, a developing roller 39 as an example of a developing agent carrier, and a layer-thickness regulating blade 40 in the developer frame 36, as shown in FIG. 2.

The developer frame 36 is formed in a box shape with the lower end portion thereof formed with an opening 41 (see FIG. 4), and divided into a toner accommodation chamber 43 and a developing chamber 44 by a partition wall 42. Moreover, the partition wall 42 is formed with a communication port 45 which communicates the toner accommodation chamber 43 and the developing chamber 44.

The toner accommodation chamber 43 accommodates a toner for a corresponding color. More specifically, the black developer cartridge 27K accommodates a black toner, the yellow developer cartridge 27Y accommodates a yellow toner, the magenta developer cartridge 27M accommodates a magenta toner, and the cyan developer cartridge 27C accommodates a cyan toner, respectively.

The toner corresponding to each color uses a positively-chargable non-magnetic single-component polymerized toner in which colorant of the yellow, magenta, cyan, or black is mixed corresponding to the color.

In addition, the toner accommodation chamber 43 is provided with detection windows 46 for detecting the residual quantity of the toner accommodated in the toner accommodation chamber 43. The detection windows 46 are embedded on both side walls 83 of the developer frame 36 (see FIGS. 8 and 9), respectively, and are disposed in an opposed relation to each other with the toner accommodation chamber 37 sandwiched therebetween.

The agitator 37 is provided in the toner accommodation chamber 43 and includes an agitator rotating shaft 47 rotatably supported on the both side walls 83 of the developer frame 36, and an agitating member 48 provided across the axial direction of the agitator rotating shaft 47 and extending outward in the radial direction from the rotation shaft.

The agitator rotating shaft 47 is transmitted with a driving force from a motor (not shown) provided in the main body casing 2 and the agitating member 48 revolve in the toner accommodation chamber 43 at the time of image formation.

The feed roller 38 is provided below the communication port 45 in the developing chamber 44. This feed roller 38 includes a metallic feed roller shaft 49 which is rotatably supported on the both side walls 83 of the developer frame 36, and a sponge roller 50 formed of electrically conductive sponge and covering the feed roller shaft 49.

The feed roller shaft 49 is transmitted with a driving force from a motor (not shown) provided in the main body casing 2 and the feed roller 38 is rotated at the time of image formation.

The developing roller 39 is provided at the position obliquely rearward below the feed roller 38 in the developing chamber 44. This developing roller 39 includes a metallic developing roller shaft 51 rotatably supported on the developer frame 36 and a rubber roller 52 formed of electrically conductive rubber and covering the developing roller shaft 51.

The developing roller 39 is disposed with respect to the feed roller 38 so that the rubber roller 52 and the sponge roller 50 are in press contact with each other. Further, the developing roller 39 is disposed so as to expose downward from the opening 41 of the developing chamber 44.

The developing roller shaft 51 is transmitted with a driving force from a motor (not shown) provided in the main body casing 2 to rotate the developing roller 39 at the time of image formation. Moreover, the developing roller 39 is applied with a developing bias.

The layer-thickness regulating blade 40 is provided in the developing chamber 44 so as to be in press contact with the developing roller 39 from above. The layer-thickness regulating blade 40 includes a blade 53 formed of a metal leaf spring, and a pressing member 54 formed in a semicircular shape as seen in section and formed of an electrically insulative silicone rubber and disposed on the distal end of the blade 53.

The proximal edge of the blade 53 is fixed to the partition wall 42 by a fixing member 55 and the pressing member 54 provided on the distal end of the blade 53 is in press contact with the rubber roller 52 of the developing roller 39 from above by the elastic force of the blade 53.

(3-2-3) Developing Operation in Processing Section

In each developer cartridge 27, the toner for the corresponding color accommodated in the toner accommodation chamber 43 moves toward the communication port 45 by its own weight and is released from the communication port 45 to the developing chamber 44 while being agitated by the agitator 37.

The toner released from the communication port 45 to the developing chamber 44 is fed to the feed roller 38. The toner fed to the feed roller 38 is then fed to the developing roller 39 by the rotation of the feed roller 38. At this time, the toner is triboelectrically positively charged between the feed roller 38 and the developing roller 39 applied with the developing bias.

The toner fed to the developing roller 39 enters between the pressing member 54 of the layer-thickness regulating blade 40 and the rubber roller 52 of the developing roller 39 along with the rotation of the developing roller 39 and carried on the surface of the rubber roller 52 as a thin layer having a constant thickness.

On the other hand, in the drum subunit 28 corresponding to each developer cartridge 27, the scorotron charger 30 generates corona discharge and positively and uniformly charges the surface of the photosensitive drum 29.

The surface of the photosensitive drum 29 is thus positively and uniformly charged by the scorotron charger 30 along with the rotation of the photosensitive drum 29, and then exposed to light by the high speed scanning of the laser beam from the scanning section 20. As a result, an electrostatic latent image can be formed, which corresponds to the image to be formed on the sheet 3.

Thereafter, by further rotation of the photosensitive drum 29, the toner which is carried on the surface of the developing roller 39 and positively charged, contacts with the photosensitive drum 28 in an opposed relation by the rotation of the developing roller 39. At this time, the toner is fed to the electrostatic latent image formed on the surface of the photosensitive drum 29, that is, a portion exposed by laser beams and has lower potential on the surface of the uniformly positively charged photosensitive drum 29. Consequently, the electrostatic latent image on the photosensitive drum 29 is visualized by developing, and the toner image for corresponding color by reversal developing is carried on the surface of the photosensitive drum 29.

The sheet dust from the sheet 3, which adheres on the surface of the photosensitive drum 29 after the transfer, is recovered by the cleaning brush 31.

(3-3) Transferring Section

The transferring section 22 is disposed above the sheet feeding section 4 and below the processing section 21 along the anteroposterior direction in the main body casing 2, as shown in FIG. 1. This transferring section 22 includes a drive roller 56, a driven roller 57, the transport belt 58, a transfer roller 59, and a cleaning section 60.

The drive roller 56 and the driven roller 57 are disposed in an opposed spaced relation to each other in the anteroposterior direction. Specifically, the drive roller 56 is disposed rearward of the cyan drum subunit 28C and the driven roller 57 is disposed forward of the black drum subunit 28K.

The transport belt 58 is an endless belt formed of a resin film such as electrically conductive polycarbonate or polyimide dispersed with electrically conductive particles such as carbon. This transport belt 58 is wound between the drive roller 56 and the driven roller 57.

The drive roller 56 is transmitted with a driving force from a motor (not shown) provided in the main body casing 2 and the drive roller 56 is rotated at the time of image formation.

The transport belt 58 is then circumferentially moved in the opposite rotation direction to that of the photosensitive drum 29 between the drive roller 56 and the driven roller 57 at the transfer position where the transport belt 58 is opposed to and contact the photosensitive drum 29 of each drum subunit 28, and the driven roller 57 follows the movement.

The transfer roller 59 is provided within the transport belt 58 wound between the drive roller 56 and the driven roller 57 SO as to be opposed to the photosensitive drum 29 with the transport belt 58 sandwiched between the photosensitive drum 29 and itself.

Each transfer roller 59 includes a metallic roller shaft, and a rubber roller formed of an electrically conductive rubber and covering the roller shaft. Moreover, each transfer roller 59 is provided so as to rotate in the same direction as that of the circumferential movement of the transport belt 58 at a transfer position in which each transfer roller 59 is opposed to and contacts with the transport belt 58. The transfer roller 59 is applied with a transfer bias at the time of image formation.

The cleaning section 60 is disposed below the transport belt 58 which is wound between the drive roller 56 and the driven roller 57, and includes a primary cleaning roller 61, a secondary cleaning roller 62, a scraping blade 63, and a toner storage member 64.

The sheet 3 fed from the sheet feeding section 4 is transported by the transport belt 58 that is circumferentially moved by the drive of the drive roller 56 and the following movement of the driven roller 57 so that the sheet 3 sequentially pass the transfer positions corresponding to the respective drum subunits 28 from the front side toward the rear side. In the midway through the transportation, the toner images of the respective colors carried on the respective photosensitive drums 29 of the drum subunits 28 are sequentially transferred, and thus a color image is formed on the sheet 3.

That is, for example, the black toner image carried on the surface of the photosensitive drum 29 of the black drum subunit 28K is transferred onto the sheet 3, then the yellow toner image carried on the surface of the photosensitive drum 29 of the yellow drum subunit 28Y is transferred and overlapped onto the sheet 3 on which the black toner image has already been transferred. Afterwards, the similar operation is repeated: the magenta toner image carried on the surface of the photosensitive drum 29 of the magenta drum subunit 28M and the cyan toner image carried on the surface of the photosensitive drum 29 of the cyan drum subunit 28C are also transferred and overlapped onto the sheet 3. As a result, a color image is formed on the sheet 3.

On the other hand, in the transferring operation as described above, in the cleaning section 60, the toner that adheres to the surface of the transport belt 58 is first transferred from the surface of the transport belt 58 to the primary cleaning roller 61 by the first cleaning bias, and then transferred to the secondary cleaning roller 62 by the second cleaning bias. Afterwards, the toner transferred to the secondary cleaning roller 62 is scratched away by the scraping blade 63, drops from the secondary cleaning roller 62 and stored in the toner storage member 64.

(3-4) Fixing Section

The fixing section 23 is anteroposteriorly opposed to the transfer position where the photosensitive drum 29 and the transport belt 58 contact with each other, behind the cyan drum subunit 28C in the main body casing 2. This fixing section 23 includes a heat roller 65 and a pressing roller 66.

The heat roller 65 is formed of a metal pipe with the surface formed with a releasable layer and is equipped therein with a halogen lamp along the axial direction thereof. The surface of the heat roller 65 is heated to a fixed temperature by the halogen lamp.

The pressing roller 66 is disposed in opposed relation to the heat roller 65 below the heat roller 65. This pressing roller 66 presses the heat roller 65 from below.

The color image transferred onto the sheet 3 is transported to this fixing section 23 and thermally fixed on the sheet 3 while the sheet 3 passes between the heat roller 65 and the pressing roller 66, thereby achieving the image formation on the sheet 3.

(4) Sheet Ejecting Section

The sheet ejecting section 6 includes a sheet ejecting transport path 67, a transport roller 68 and a pinch roller 69 provided in an opposed relation to each other, a pair of the sheet ejecting rollers 70 and a sheet ejection tray 71.

The sheet 3 transported from the fixing section 23 is transported by the transport roller 68 and the pinch roller 69 along the sheet ejecting transport path 67, and the sheet ejecting roller 70 ejects the sheet 3 on the sheet ejection tray 71.

2. Developer Cartridge

Figure 3:
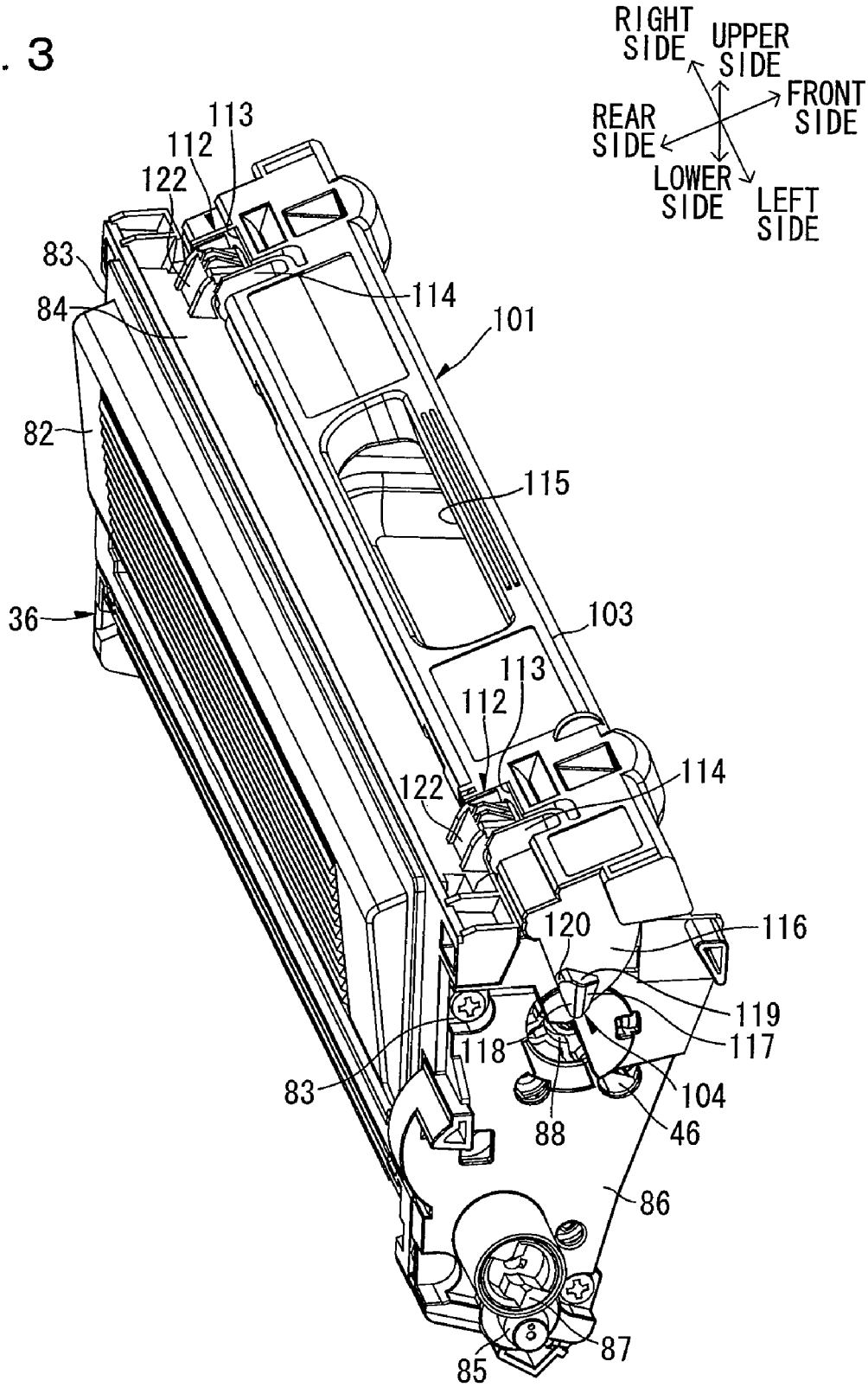
FIG. 3 is a perspective view of the developer cartridge.
Figure 4:
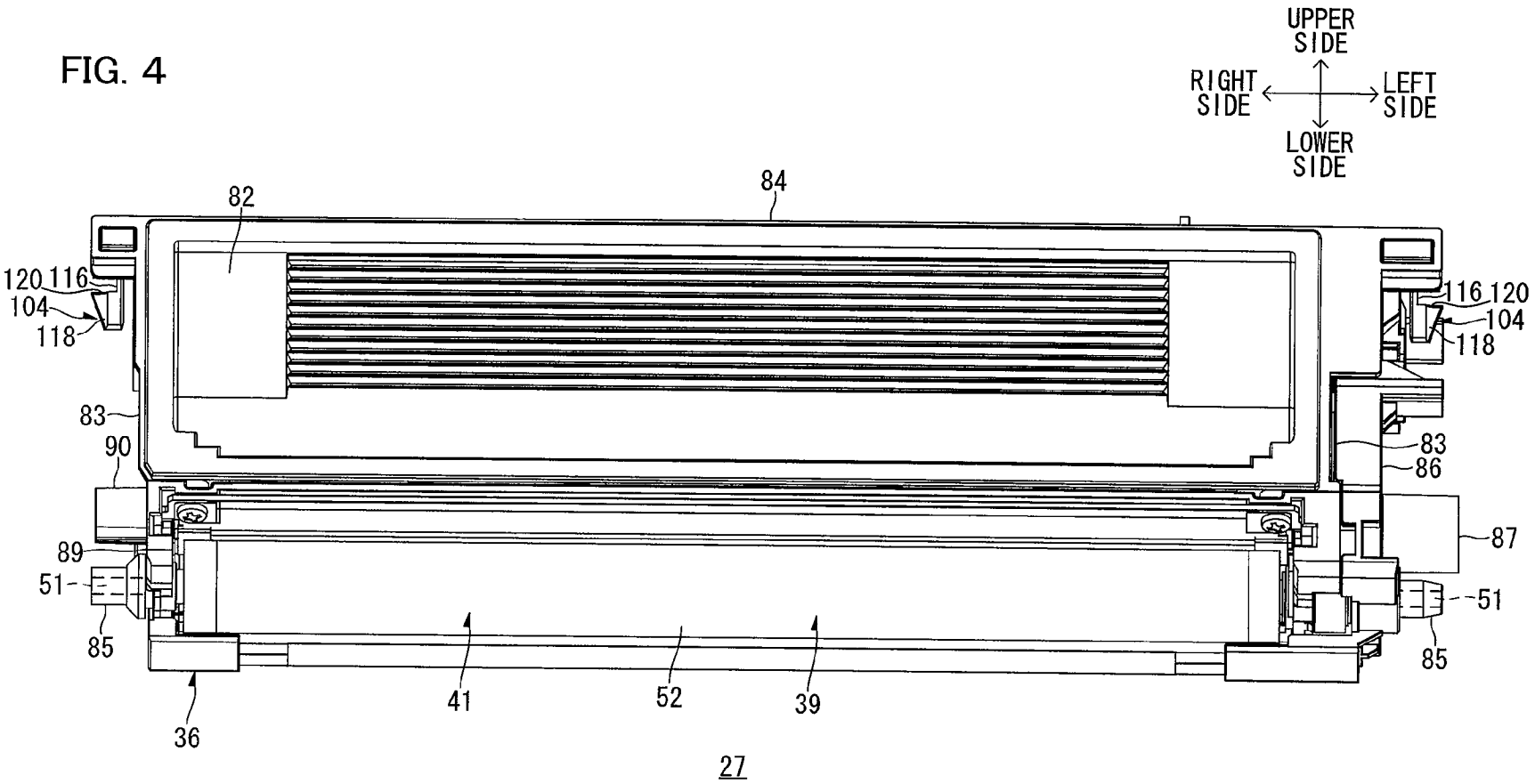
FIG. 4 is a rear view of the developer cartridge.
Figure 5:
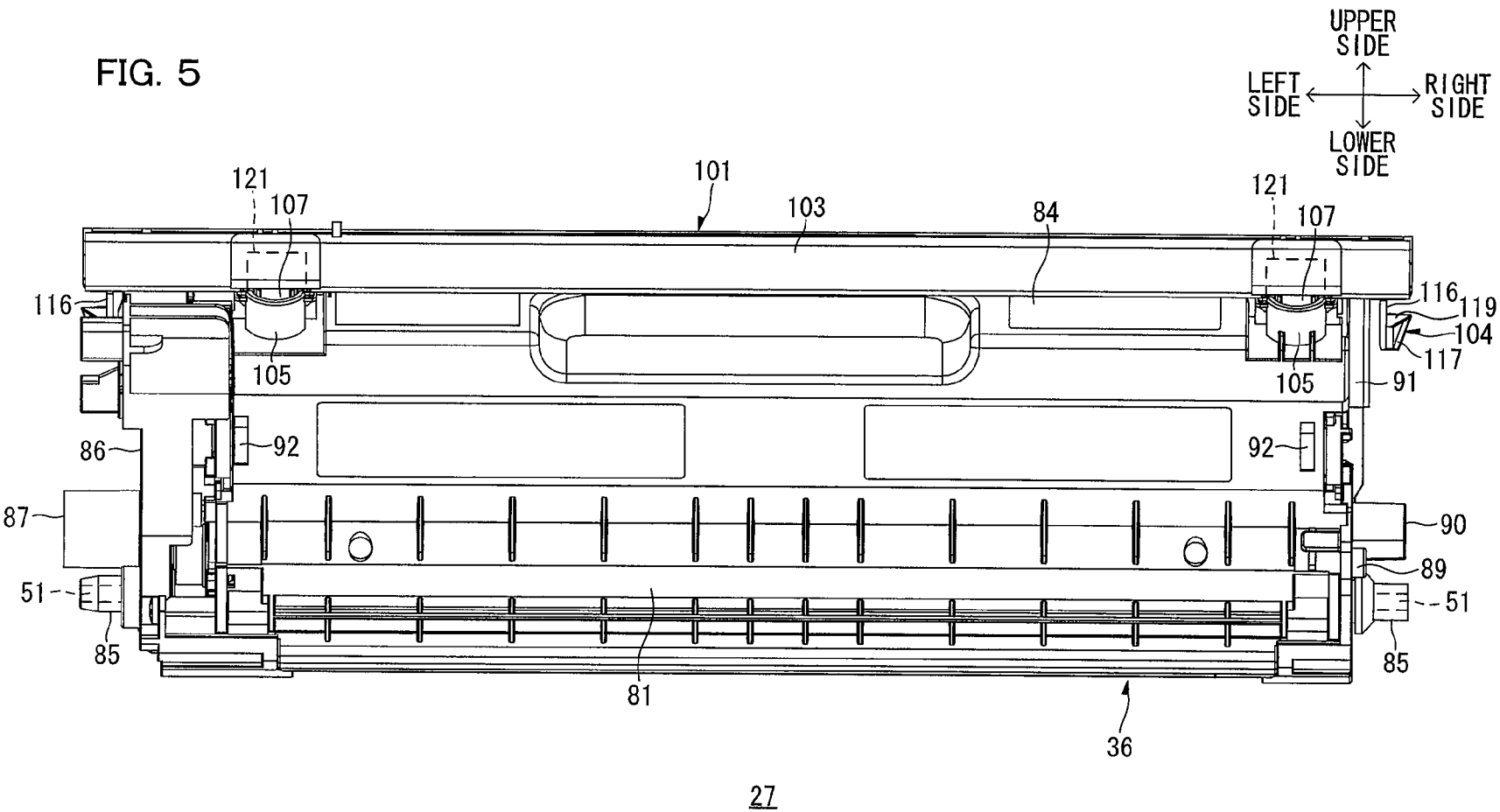
FIG. 5 is a front view of the developer cartridge.
Figure 6:
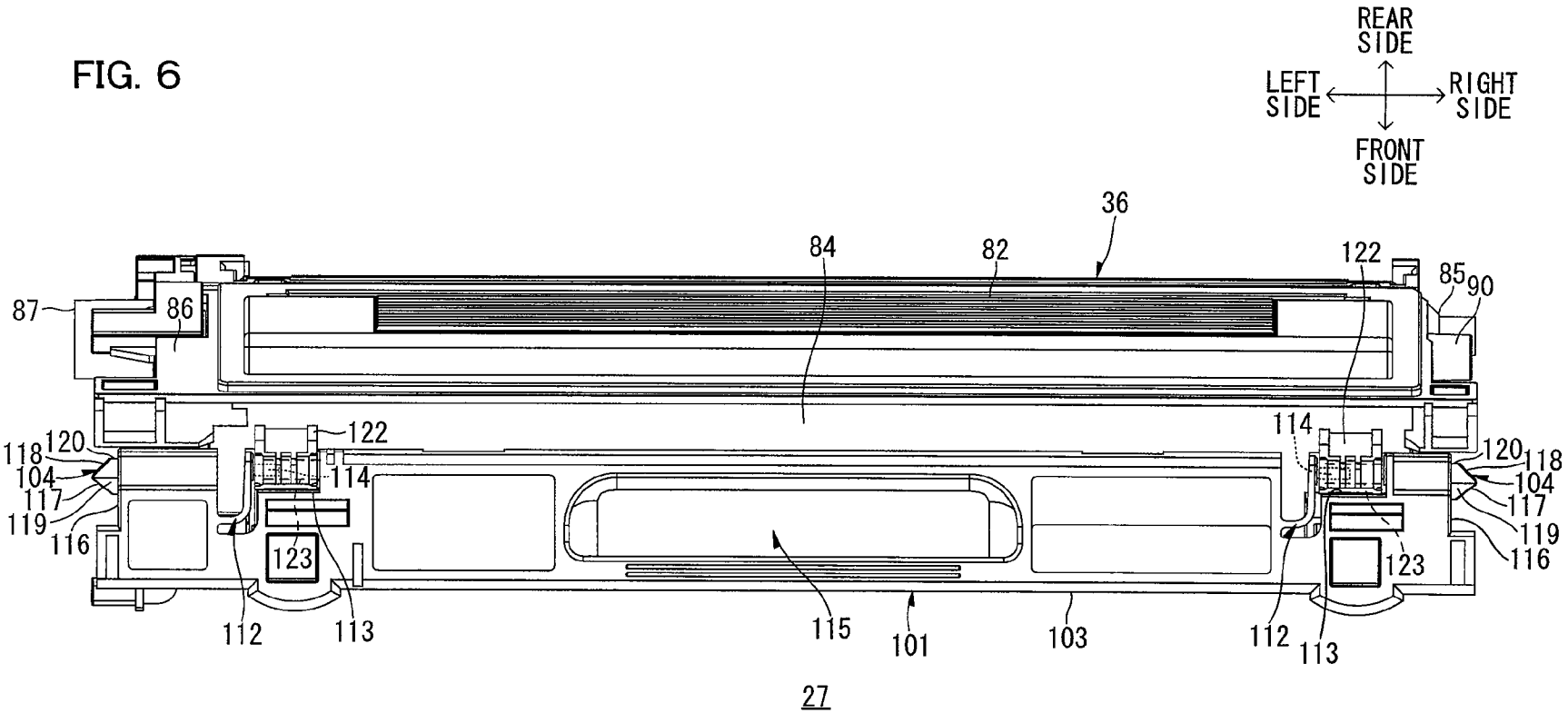
FIG. 6 is a plan view of the developer cartridge.
Figure 7:
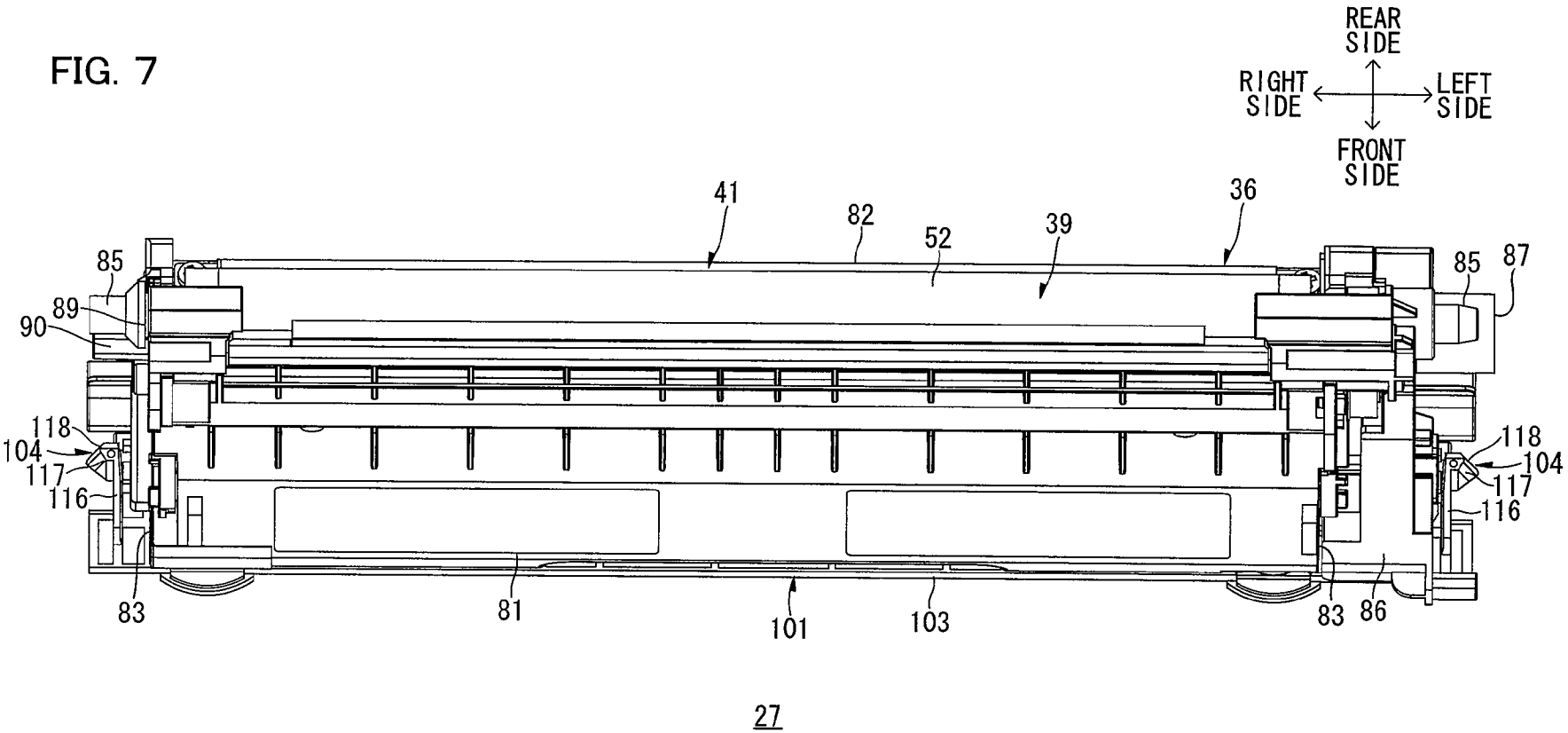
FIG. 7 is a bottom view of the developer cartridge.
Figure 8:
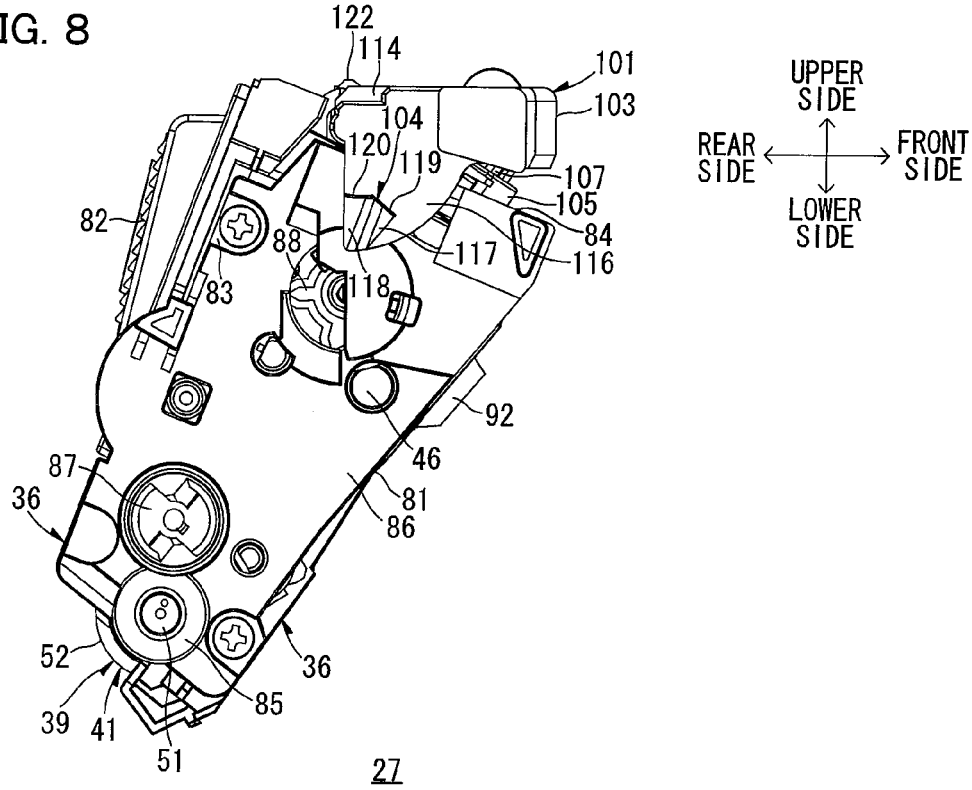
FIG. 8 is a left side view of the developer cartridge.
Figure 9:
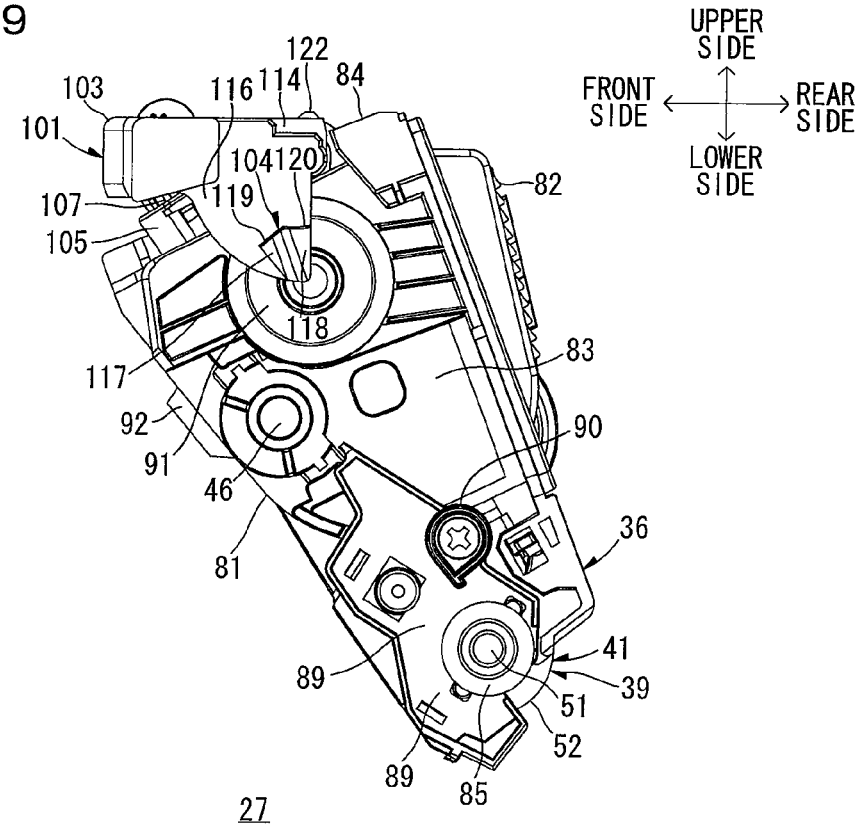
FIG. 9 is a right side view of the developer cartridge.
Figure 10:
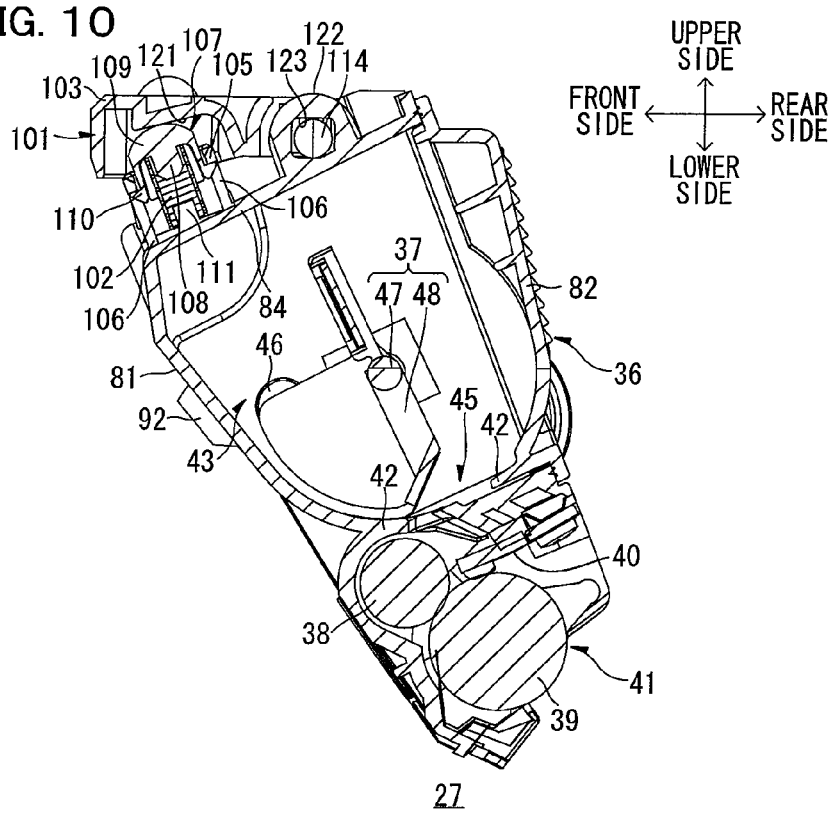
FIG. 10 is a sectional view of the developer cartridge in a non-pressed state.
Figure 11:
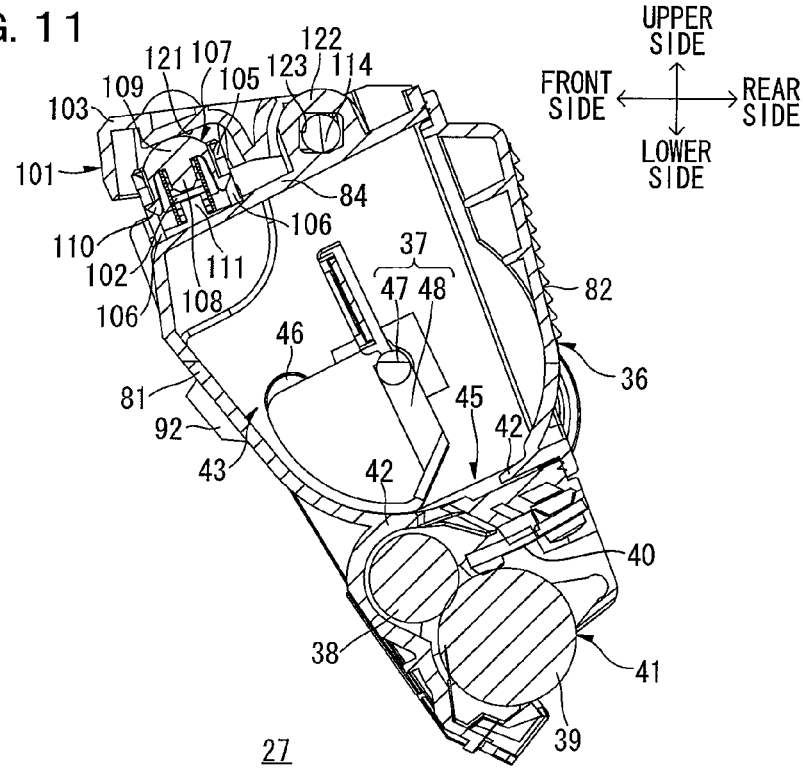
FIG. 11 is a sectional view of the developer cartridge in a pressed state.

FIG. 3 is a perspective view of the developer cartridge. FIG. 4 is a rear view of the developer cartridge. FIG. 5 is a front view of the developer cartridge. FIG. 6 is a plan view of the developer cartridge. FIG. 7 is a bottom view of the developer cartridge. FIG. 8 is a left side view of the developer cartridge. FIG. 9 is a right side view of the developer cartridge. FIG. 10 is a sectional view of the developer cartridge in a non-pressed state. FIG. 11 is a sectional view of the developer cartridge in a pressed state.

With reference to FIGS. 3 to 11, the developer cartridge is described hereinafter in greater detail.

(1) Developer Frame

As described above and shown in FIG. 4, the developer frame 36 is formed in a box shape and formed with the opening 41 in the lower end portion thereof and integrally includes the pair of side walls 83 disposed in an opposed spaced relation in the width(lateral) direction, an upper wall 84 extending between the upper end edges of the both side walls 83, a front wall 81 extending between the front end edges of the both side walls 83 (see FIG. 5), and a rear wall 82 extending between the rear end edges of the both side walls 83.

The lower end edges of the both side walls 83, the front wall 81, and the rear wall 82 define the opening 41 which exposes the developing roller 39.

The both side walls 83 of the developer frame 36 rotatably support the developing roller shaft 51, and axial both end portions of the developing roller shaft 51 are provided so as to protrude from the both side walls 83 toward both sides in the width direction, respectively. The axial both end portions of the developing roller shaft 51 are each covered with an electrically conductive collar member 85.

The developer frame 36 has on the left side wall 83 a gear mechanism (not shown) and a gear cover 86 provided so as to cover the gear mechanism, as shown in FIG. 8.

The gear mechanism (not shown) includes a coupling gear 87 and a gear train (not shown). The gear train includes an agitator driving gear which meshes with the agitator rotating shaft 47 of the agitator 37, a feed roller driving gear which meshes with the feed roller shaft 49 of the feed roller 38, a developing roller driving gear which meshes with the developing roller shaft 51 of the developing roller 39, and a detection gear 88, all of which mesh with the coupling gear 87 via an intermediate gear or the like.

This coupling gear 87 is coupled with a coupling shaft (not shown) provided in the main body casing 2 so as to freely move forward and backward and not to relatively rotate. A driving force from a motor (not shown) provided in the main body casing 2 is transmitted via this coupling shaft to the coupling gear 87. The driving force is transmitted from the coupling gear 87 to the agitator driving gear, the feed roller driving gear, the developing roller driving gear and the detection gear 88, thereby rotating the agitator rotating shaft 47, the feed roller shaft 49, and the developing roller shaft 51. The detection gear 88 is formed as a partially non-toothed gear and determines whether the developer cartridge 27 is old or new based on whether the gear rotates or not.

The gear cover 86 has an opening to expose the coupling gear 87 and the detection gear 88 and is provided on the left side wall 83 so as to expose the coupling gear 87 and the detection gear 88 from the opening and to cover the gear train.

The developer frame 36 includes an electrically conductive current supply member 89 on the right side wall 83, as shown in FIG. 9. This current supply member 89 slidably supports the developing roller shaft 51 of the developing roller 39 between the right side wall 83 and the collar member 85, and integrally includes a contacting plate 90 which protrudes laterally outward.

The contacting plate 90 is applied with a developing bias from a power source (not shown) provided in the main body casing 2. The developing bias is applied to the developing roller shaft 51 via the power supply member 89.

The right side wall 83 is provided with a cap 91 above the detection window 46 to close the toner filling opening (not shown) for filling the toner into the toner accommodation chamber 43.

The developer frame 36 is provided with positioning convex portions 92 on both the right and left end portions of the front wall 83, respectively, as shown in FIG. 5. Each positioning convex portion 92 is formed in a generally trapezoidal shape as seen from the side (see FIGS. 8 and 9) and protrudes forward from the front wall 81.

(2) Attachment/Detachment Operating Part

The developer frame 36 is provided with an attachment/detachment operating portion 101 to attach and detach from the developer cartridge 27, as shown in FIG. 3.

This attachment/detachment operating portion 101 is disposed on the upper wall 84 of the developer frame 36 and includes a spring 102 and an abutting member 107 as an example of elastic members (see FIG. 10), the grip 103 as an example of a pressing member for pressing the spring 102 and the abutting member 107 toward the developing roller 39, and a fitting projection 104 as an example of an engaging member provided on the grip 103.

The front end portion of the upper wall 84 is formed with two spring receiving cylindrical portion 105 disposed at an interval which is generally equal to the lateral length (length in the axial direction) of the rubber roller 52 of the developing roller 39 on the both end portions thereof in the width direction (same direction as the axial direction of the developing roller 39), respectively, as shown in FIGS. 5 and 10.

Each spring receiving cylindrical portion 105 is in a cylindrical shape and protrudes upward from the upper wall 84. In each spring receiving cylindrical portion 105, a plurality of engaging grooves 106 are formed in a spaced relation in the circumferential direction thereof and extend from the lower end portion of the spring receiving cylindrical portion 105 to the midway thereof in the up-and-down direction.

Further, each spring receiving cylindrical portion 105 is provided with a mounting boss 111 having a diameter smaller than the spring receiving cylindrical portion 105 and provided in a spaced relation to the inner circumferential surface of the spring receiving cylindrical portion 105. This mounting boss 111 is formed in a cylindrical shape and protrudes upward from the upper wall 84.

Moreover, each spring receiving cylindrical portion 105 is provided with the spring 102, and the abutting member 107 which fits to the spring 102 and can move forward and backward in up-and-down direction.

The spring 102 is a coil spring (compression spring), inserted between the inner circumferential surface of the spring receiving cylindrical portion 105 and the mounting boss 111, and disposed in the lower portion of the spring receiving cylindrical portion 105.

The abutting member 107 integrally includes a boss portion 108, and a head portion 109 bulging in the radial direction from the upper end portion of the boss portion 108. In addition, the circumferential end portion of the head portion 109 is formed integrally with a plurality of hook-shaped hook portions 110 extending downward corresponding to the engagement grooves 106.

In the abutting member 107, the boss portion 108 is disposed on the spring 102 in the upper portion of the spring receiving cylindrical portion 105, the head portion 109 is disposed on the spring receiving cylindrical portion 105, and the hook portion 110 is engaged with the engaging groove 106 of the spring receiving cylindrical portion 105 so as to be slidable in up-and-down direction.

The abutting member 107 is constantly urged upward by the spring 102, while the hook portion 110 is engaged with the upper end portion of the engaging groove 106, thereby preventing the abutting member 107 from being detached from the spring receiving cylindrical portion 105.

The grip 103 is formed in a thin plate shape extending in the width direction, and the rear end portion thereof is integrally formed with two grip mounting portions 112 in a spaced relation to each other on both lateral end portions, respectively, as shown in FIG. 3.

Each grip mounting portion 112 is formed with a notched portion 113 which is cut away forward from the rear end edge of the grip 103 in a generally rectangular shape as seen from the top. On the respective inner side walls of the notched portion 113, elastically deformable pivoting shafts 114 protrude toward the direction toward which they come close to each other (inward direction in the width direction), as shown in FIG. 6.

The grip 103 is formed, in the lateral center thereof, with a grasp hole 115 which is formed in an elongated rectangular shape as seen from the top and extends in the width direction, as shown in FIG. 3. At the time of attaching and detaching operation of the developer cartridge 27, the operator's fingers are inserted in this grasp hole 115 to hold the grip 103.

Moreover, in the grip 103, recesses 121 which serve as an example of a transmission portion and can receive each abutting member 107 are formed at a position laterally inward of the upper wall 84 and opposed to the abutting member 107 on the lower surface (opposed surface with the upper wall 84) thereof, as shown in FIGS. 5 and 10. Each recess 121 is formed in a generally circular shape as seen from the rear to be able to receive the abutting member 107.

The grip 103 is provided with a projection support plate 116 formed to bend downward from each of the both end edges in the width direction.

Each projection support plate 116 is formed in a fan-shape as seen from the side and provided with the fitting projection 104 in the lower end portion thereof.

The fitting projection 104 is formed in a generally triangular shape as seen from the side which tapers downward, (more specifically, a generally diamond shape whose upper end edge is formed as a reversed V-shape), and protrudes laterally outward from the lower end portion of each projection support plate 116, as shown in FIGS. 8 and 9.

The end face of the front end portion of each fitting projection 104 is formed as a front-side inclined surface 117 which inclines forward and laterally inward from the center portion of the fitting projection 104 in the anteroposterior direction, (in other words, inclines to the pivot plane including the pivoting direction of the grip 103 and the axial plane including the axial direction (width direction) orthogonal to the pivot plane), as shown in FIG. 3.

Further, the end face of the rear end portion of the fitting projection 104 is formed as a rear-side inclined surface 118 which inclines rearward and laterally inward from the center portion of the fitting projection 104 in the anteroposterior direction, (in other words, inclines to the pivot plane including the pivoting direction of the grip 103 and the axial plane including the axial direction (width direction) orthogonal to the pivot plane).

Furthermore, the end surface of the upper end portion of the fitting projection 104 is formed of a front end face 119 and a rear end face 120 having different angles, as shown in FIGS. 8 and 9. More specifically, the front end face 119 and the rear end face 120 are inclined downward and gradually spaced apart outward in the anteroposterior direction from the center portion in the anteroposterior direction as seen from the side. The front end face 119 and the rear end face 120 are each formed flat along the width direction as a right angle surface which bends at a generally right angle from the side surface of the center portion of the fitting projection 104 in the anteroposterior direction.

The rear end portion of the upper wall 84 is provided with two grip support portions 122 on the both lateral end portions thereof, respectively, corresponding to the grip mounting portions 112, as shown in FIGS. 3 and 10.

Each grip support portion 122 is formed in a generally U-shape as seen from the side, formed with a penetration hole 123 along the width direction, and extends in the width direction.

The grip 103 brings the pivoting shaft 114 of each grip mounting portion 112 into abutment against the corresponding grip support portion 122 and fits it in each penetration hole 123 while elastically deforming it. Accordingly, the grip 103 is rotatably supported on the upper wall 84 of the developer frame 36 so that the width direction corresponds to the pivoting axis thereof.

As a result, when the grip 103 is pivoted toward the downward and rearward direction (pressing direction which is described later), the grip 103 is pivoted toward the abutting member 107 disposed on the downstream side of the downward and rearward direction, thereby locating the grip 103 at a contact position where the recess 121 of the grip 103 is brought into contact with the abutting member 107. On the other hand, when the grip 103 is pivoted toward the upward and forward direction (direction for releasing the pressing force which is described later), the grip 103 is located at a spaced position where the recess 121 of the grip 103 is spaced apart from the abutting member 107.

3. Drum Unit

Figure 12:
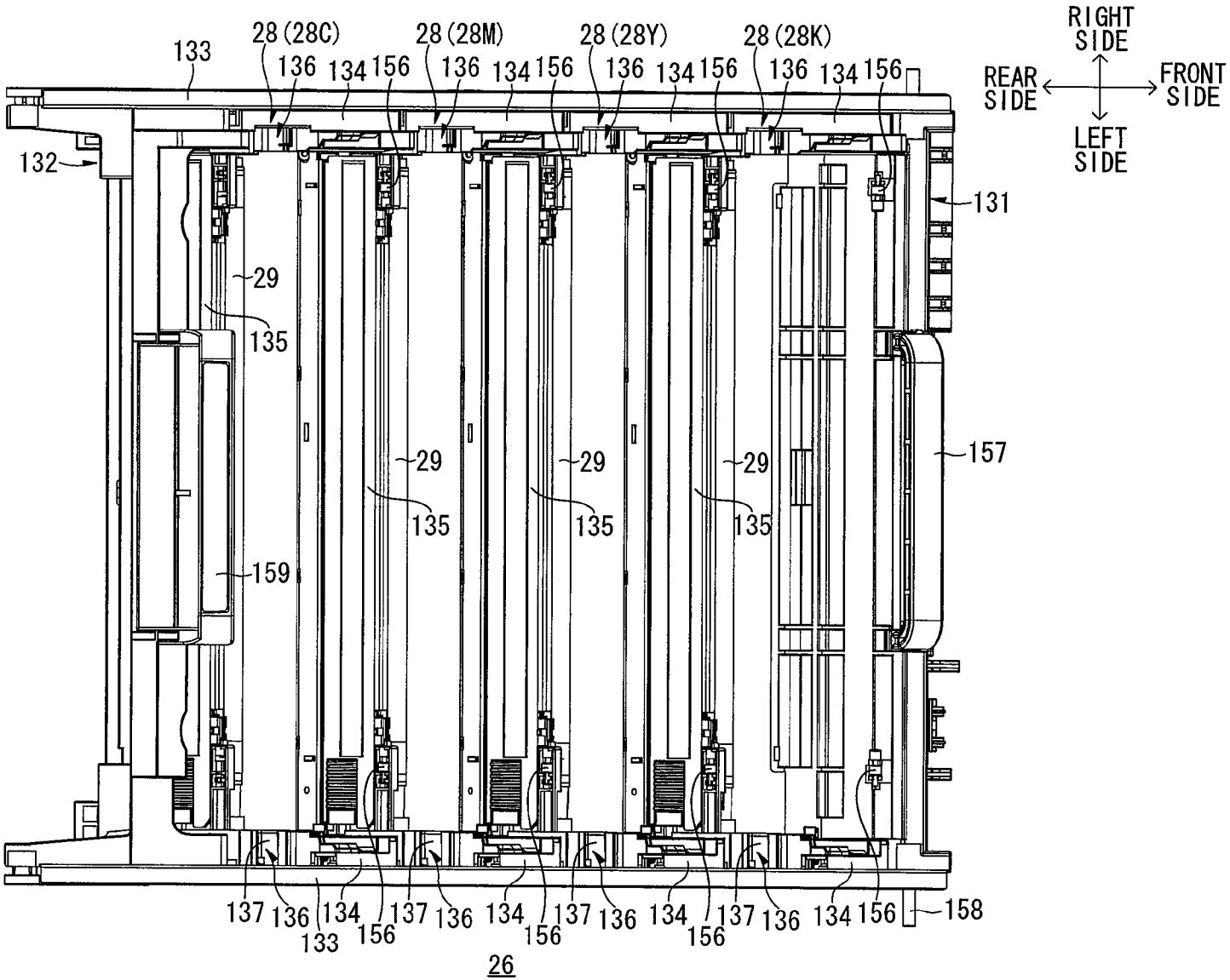
FIG. 12 is a plan view of the drum unit.
Figure 13:
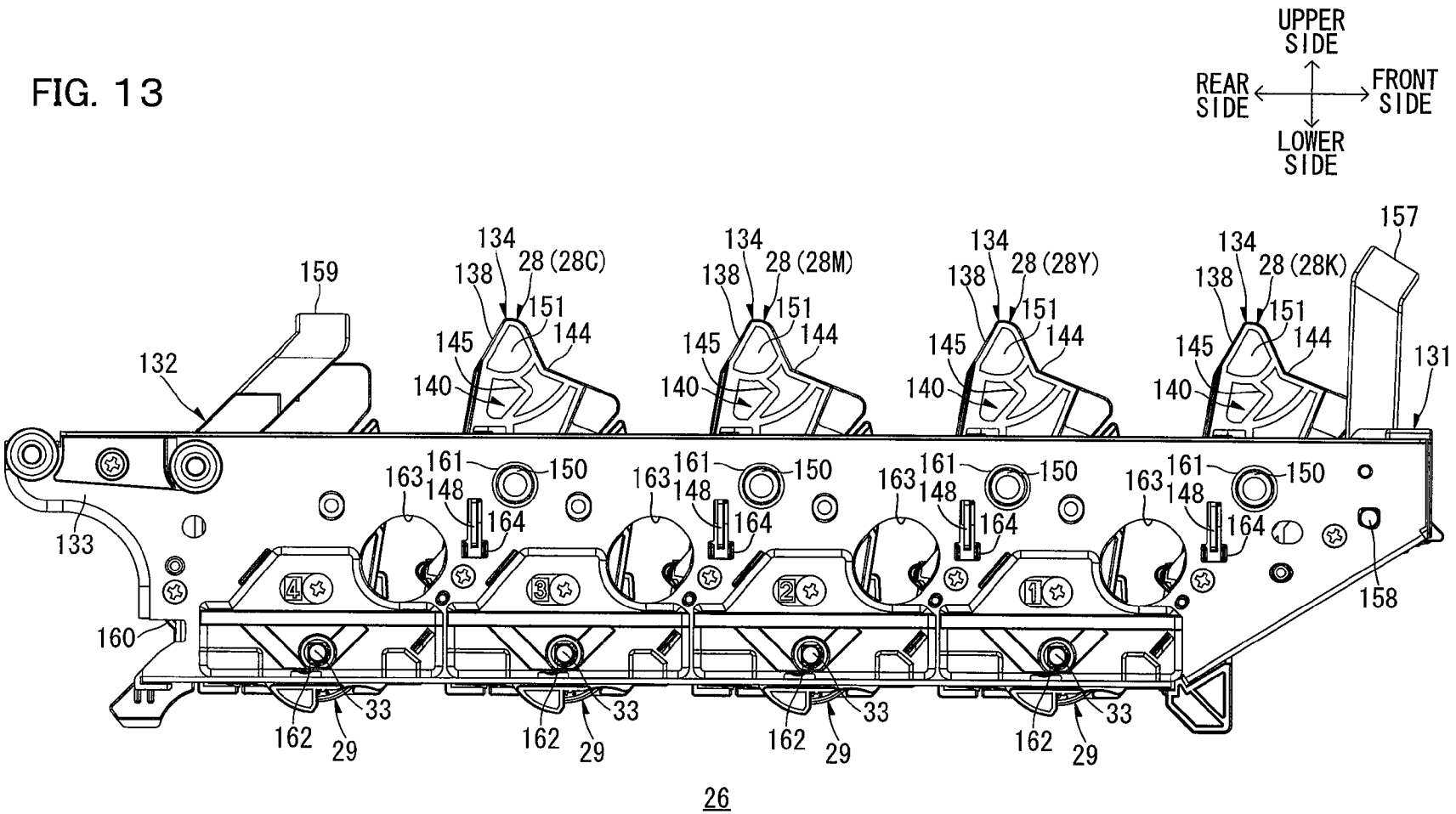
FIG. 13 is a left side view of the drum unit.
Figure 14:
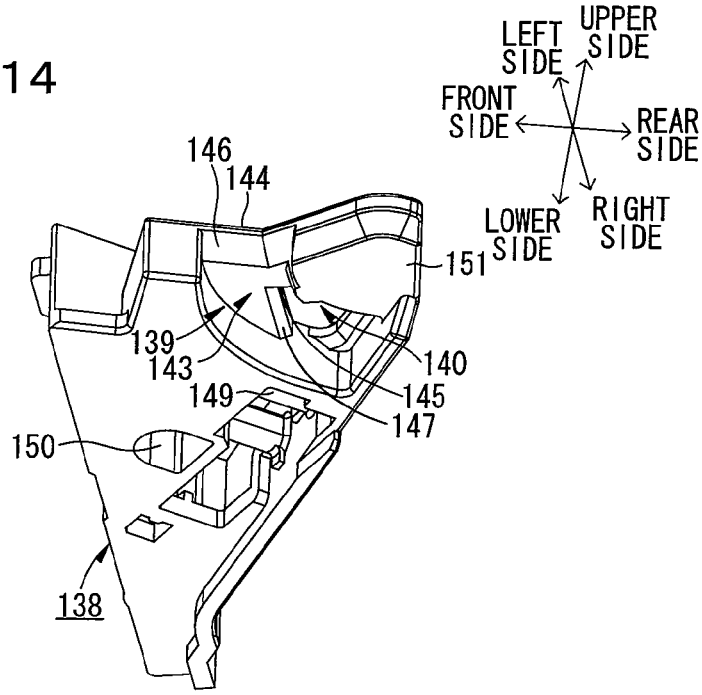
FIG. 14 is a perspective view of a portion of a left side frame forward of a guide groove as seen from above the right front.
Figure 15:
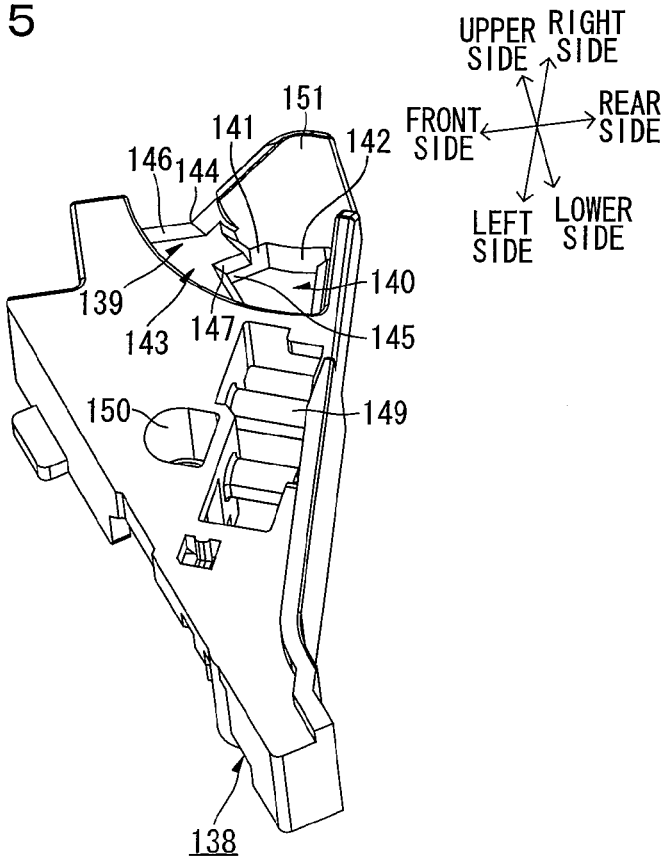
FIG. 15 is a perspective view of the portion of the left side frame forward of the guide groove as seen from below the right front.
Figure 16:
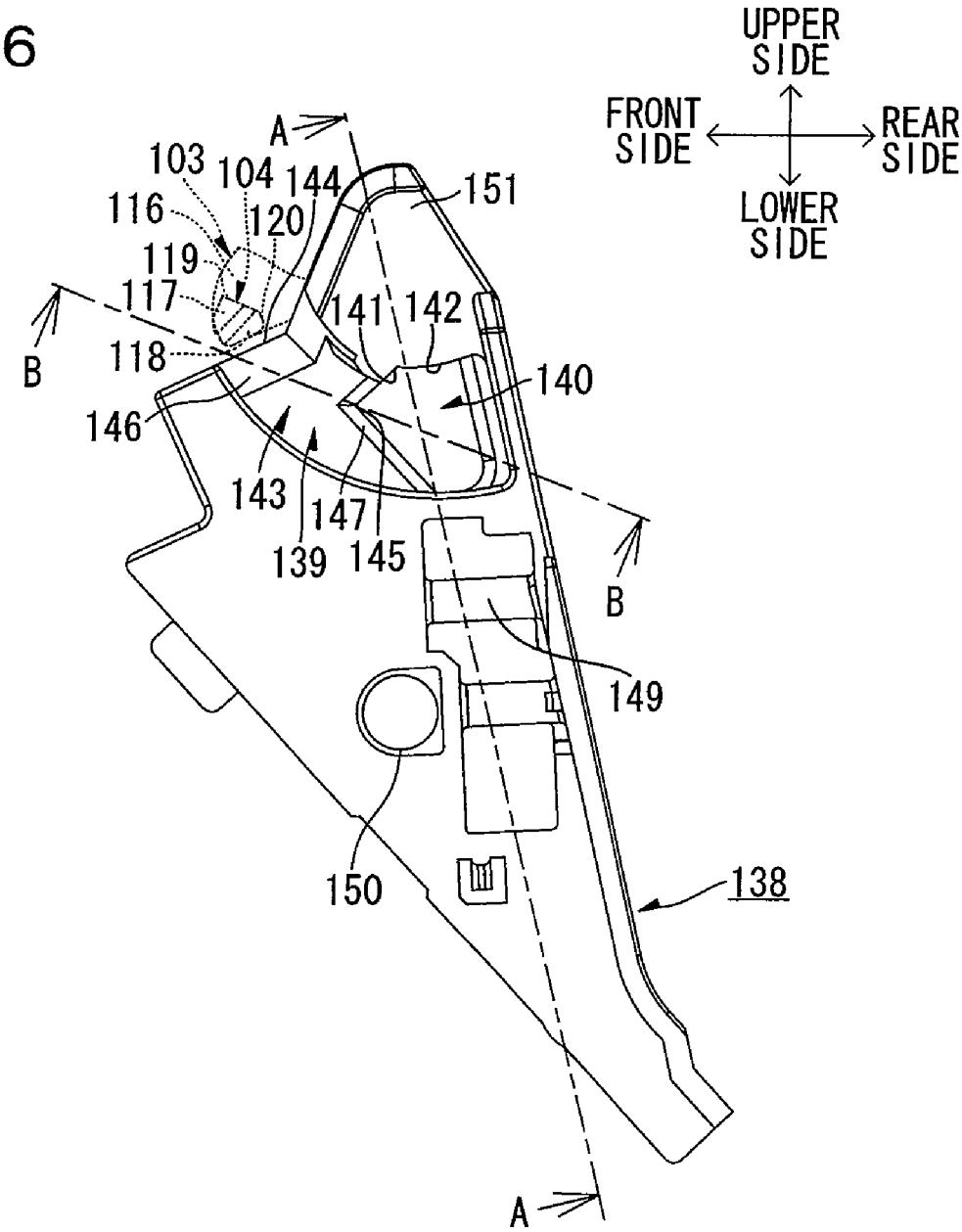
FIG. 16 is a right side view of the portion of the left side frame forward of the guide groove.
Figure 17:
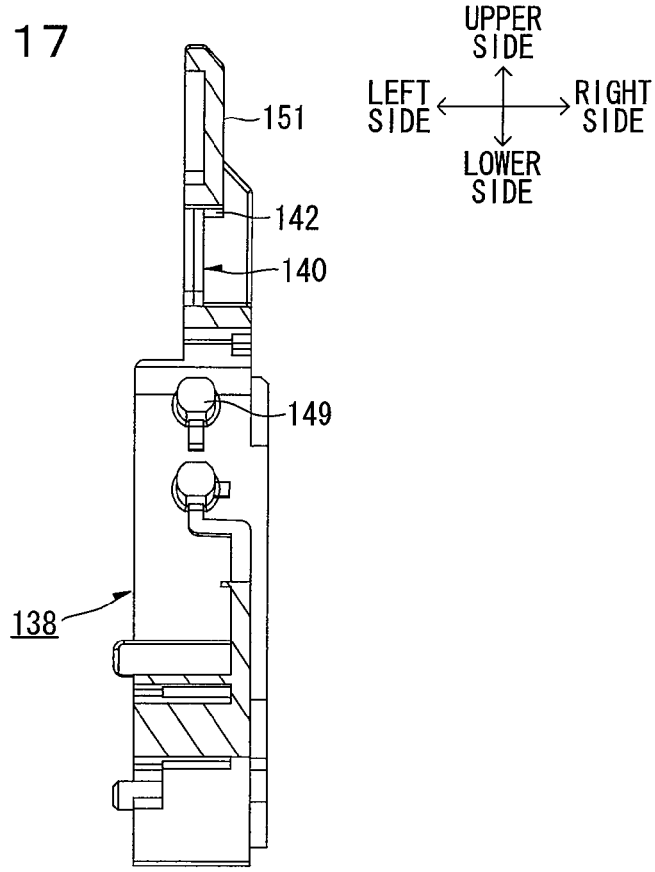
FIG. 17 is a plan view of a section taken along a line A-A and seen in the arrow direction A in FIG. 16.
Figure 18:
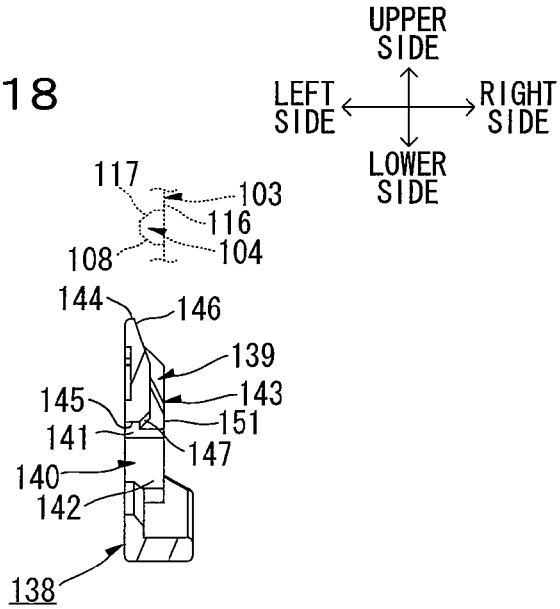
FIG. 18 is a plan view of a section taken along a line B-B and as seen in the arrow direction B in FIG. 16.
Figure 19:
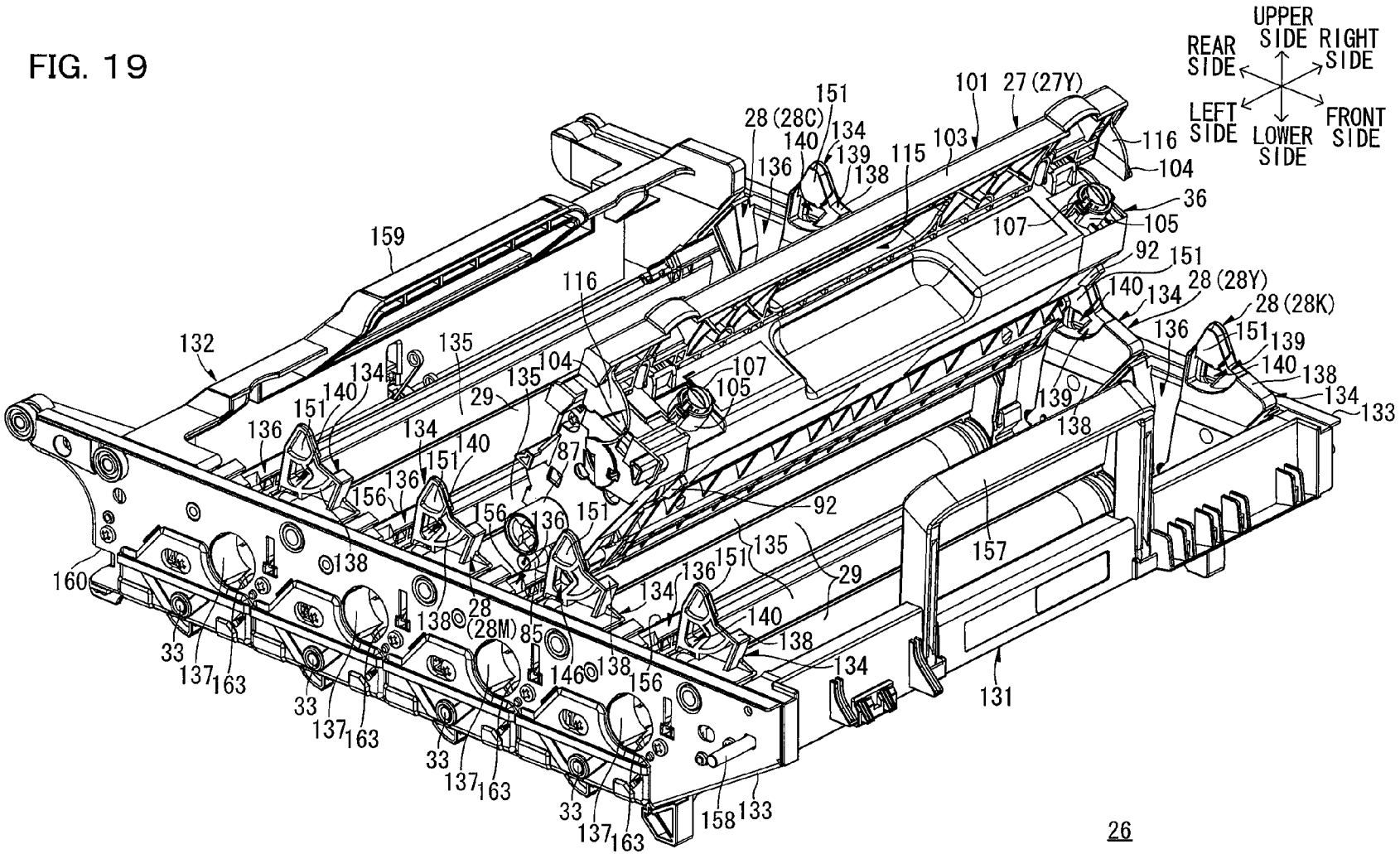
FIG. 19 is a perspective view of the drum unit (in a state where the developer cartridge is being attached or detached) as seen from above the left front side.
Figure 20:
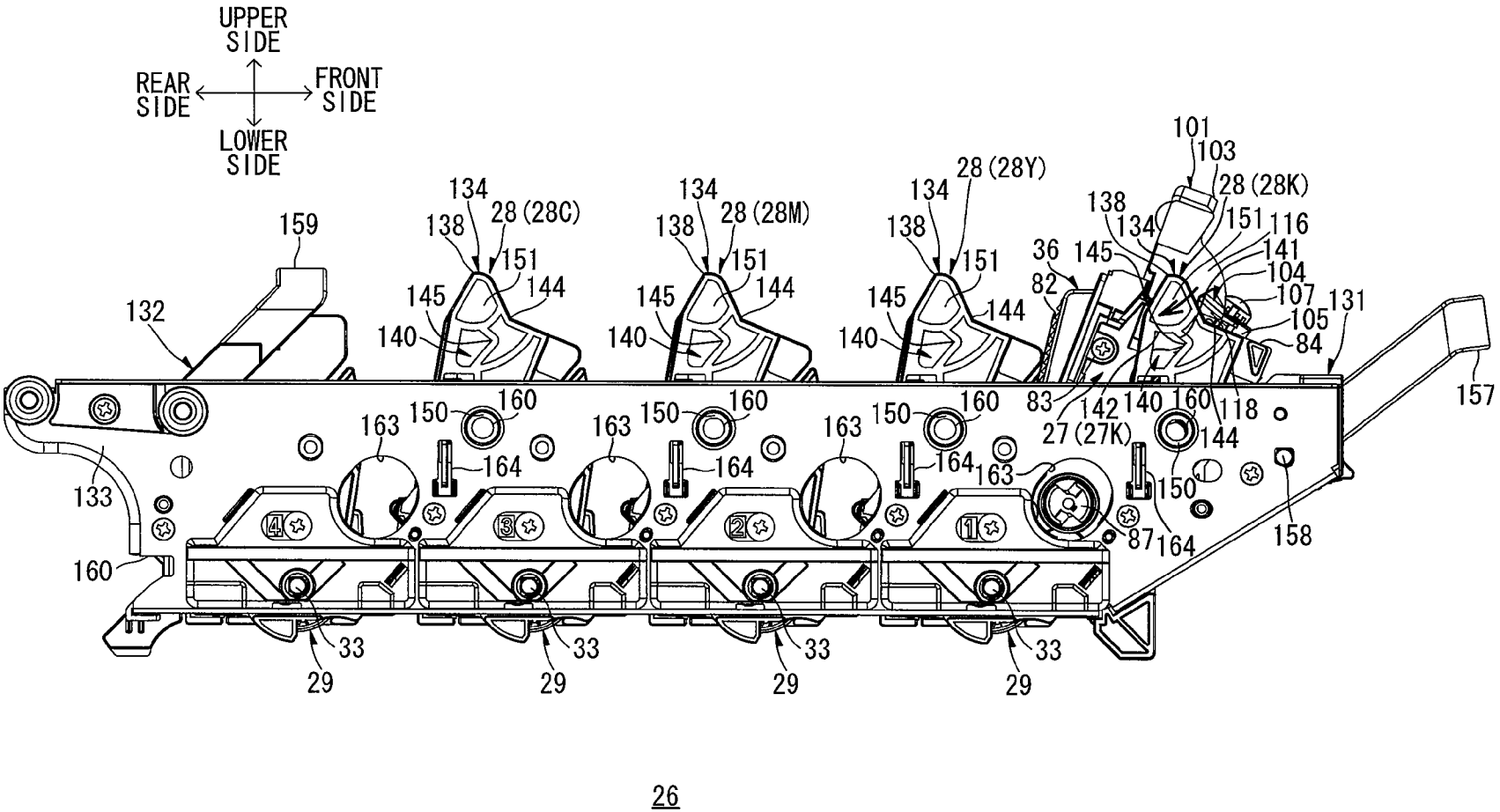
FIG. 20 is a left side view of the drum unit in a state where the developer cartridge is attached (in a state where a grip is at a spaced position).
Figure 21:
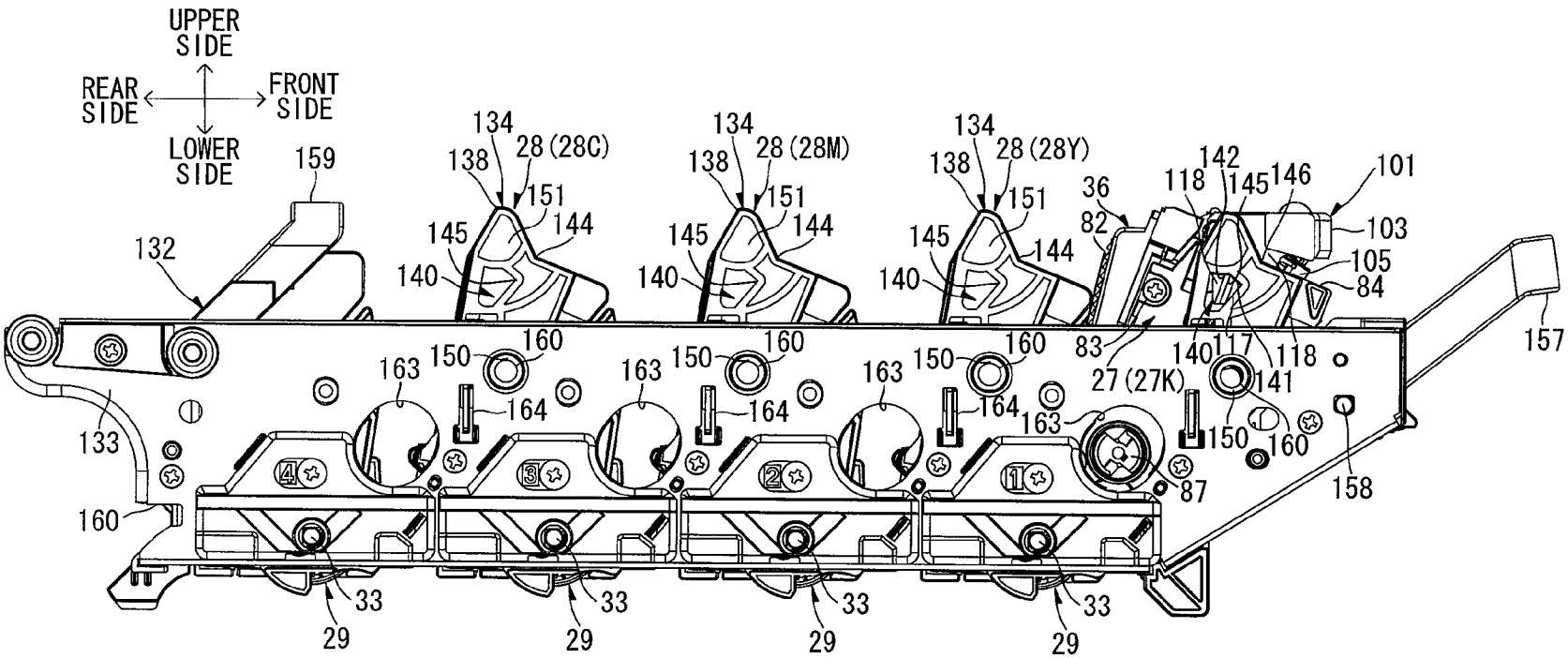
FIG. 21 is a left side view of the drum unit in a state where the developer cartridge is attached (in a state where the grip is at a contact position).

FIG. 12 is a plan view of the drum unit. FIG. 13 is a left side view of the drum unit. FIG. 14 is a perspective view of a portion of the left side frame forward of the guide groove as seen from above the right front. FIG. 15 is a perspective view of the portion of the left side frame forward of the guide groove as seen from below the right front. FIG. 16 is a right side view of the portion of the left side frame forward of the guide groove. FIG. 17 is a plan view of the section taken along the line A-A seen in the arrow direction A in FIG. 16. FIG. 18 is a plan view of the section taken along the line B-B seen in the arrow direction B in FIG. 16. FIG. 19 is a perspective view of the drum unit (in a state where the developer cartridge is being attached) as seen from above the left front side. FIG. 20 is a left side view of the drum unit in a state where the developer cartridge is attached (in a state where the grip is at the spaced position). FIG. 21 is a left side view of the drum unit in a state where the developer cartridge is attached (in a state where the grip is at a contact position).

With reference to FIGS. 12 to 21, the drum unit is described hereinafter in greater detail.

The drum unit 26 includes four drum subunits 28 corresponding to the respective colors disposed in parallel along the anteroposterior direction, a front beam 131 and a rear beam 132 respectively disposed on both sides of the four drum subunits 28 in the anteroposterior direction, and the pair of side plates 133 which sandwich the front beam 131, the four drum subunits 28 and the rear beam 132 from both sides in the width direction (right-and-left direction), as shown in FIG. 12.

The drum unit 26 is detachably attached to the drum receiving space 7 in the main body casing 2 in a slidable manner (refer to FIG. 1). At this time, the four drum subunits 28, the front beam 131, the rear beam 132 and the pair of side plates 133 are moved simultaneously.

(1) Drum Subunit

Each drum subunit 28 includes the pair of side frames 134 disposed in an opposed spaced relation in the width direction, and the center frame 135 extending between the both side frames 134 along the width direction, as shown in FIGS. 12 and 19.

(1-1) Side Frame

Each side frame 134 is formed of a resin material and in a flat plate shape as shown in FIG. 19. Each side frame 134 is inserted through by the drum shaft 33 of the photosensitive drum 29.

Each side frame 134 is formed with a cartridge guide groove 136 for guiding the attaching and detaching of the developer cartridge 27 to and from the drum subunit 28.

This cartridge guide groove 136 is formed along generally up-and-down direction from the rear side upper end edge of the side frame 134 to the vicinity of the front-side lower end of the side frame 134. The lower end portion (the deepest portion) thereof is arranged corresponding to the position of the developing roller shaft 51 in the position where the developing roller 39 contacts the photosensitive drum 29. The collar member 85 is slidably received in the cartridge guide groove 136.

The left side frame 134 is formed with a coupling inner insertion hole 137 to which the coupling gear 87 of the developer cartridge 27 is opposed in the width direction. This coupling inner insertion hole 137 is formed as a round hole penetrating the left side frame 134 in the thickness direction.

A portion of each side frame 134 forward of the cartridge guide groove 136 (hereinafter referred to as a front portion 138) is formed in a generally triangular shape as seen from the side and tapers downward).

The front end portion of the front portion 138 is formed with a protruding portion 151 which protrudes upward, and the upper end edge of the front portion 138 which continues to the protruding portion 151 is formed flat.

Below the protruding portion 151, a fitting hole 140 is formed as an example of an engagement portion.

This fitting hole 140 is provided to extend through the front portion 138 in the thickness direction (width direction) and formed in a generally triangular shape as seen from the side which tapers downward (more specifically, a generally diamond shape whose upper end edge is formed as a reversed V-shape), as shown in FIG. 16. This fitting hole 140 is formed in a similar figure (see FIG. 21) slightly larger than the fitting projection 104 of the developer cartridge 27 as seen from the side.

In the inner circumferential surface of the fitting hole 140, the end face of the upper end portion thereof is formed of an upper front end face 141 and an upper rear end face 142 each having a different angle, as shown in FIG. 15. More specifically, the upper front end face 141 and the upper rear end face 142 are gradually spaced apart from the center portion thereof in the anteroposterior direction outward in the anteroposterior direction as seen from the side, and the upper rear end face 142 extends in the horizontal direction (anteroposterior direction) and the upper front end face 141 inclines downward, as shown in FIG. 16.

As described later, the upper front end face 141 and the upper rear end face 142 are oppose to the front end face 119 and the rear end face 120 of the upper end portion of the fitting projection 104, respectively, in the engaging state of the fitting projection 104 in the fitting hole 140 (see FIG. 21), and formed flat in the direction orthogonal to the opposed direction (except the front end portion of the upper front end face 141, as described later) as shown in FIG. 17. That is, the upper front end face 141 and the upper rear end face 142 are each formed flat along the width direction as a right angle surface which bends at a generally right angle from the internal surface of the front portion 138 in the vicinity of the fitting hole 140 (except the front end portion of the upper front end face 141, as described later).

In the front portion 138, a portion between a generally V-shape portion 144 (referred to hereinafter as an "upper V-shape portion 144") and a generally V-shape portion 145 (referred to hereinafter as a "lower V-shape portion 145") serves as a passage portion 143. The upper V-shape portion 144 is formed by the front end portion of the protruding portion 151 and the rear side portion of the upper end edge of the front portion 138 continuing the protruding portion 151. The lower V-shape portion 145 is formed by the front end portion of the upper front end face 141 and the front side portion of the front end edge of the internal circumferential surface of the fitting hole 140 continuing the front end portion of the upper front end face 141. As described later, the fitting projection 104 traverses the passage portion 143 when the fitting projection 104 is fitted in the fitting hole 140 or this fitting is released by the pivot of the grip 103.

This passage portion 143 is formed with a projection guide groove 139 as an example of a guide groove that guides the passage of the fitting projection 104.

This projection guide groove 139 is formed in a circular arc along the pivot path of the fitting projection 104 as seen from the side, and formed as a gutter-shaped path which concaves from the internal surface of the front portion 138 laterally outward, as shown in FIGS. 14 and 15.

In the projection guide groove 139, the end face of the upper end portion that is continuous from the upper V-shape portion 144 is formed as an upper inclined surface 146 which inclines upward and laterally outward from the midway portion of the projection guide groove 139 in the up-and-down direction(in other words, inclines with respect to the pivot plane including the pivoting direction of the grip 103 and the axial plane including the axial direction (width direction) orthogonal to the pivot plane), as shown in FIGS. 14 and 18.

In the projection guide groove 139, the end face of the lower end portion that is continuous from the lower V-shape portion 145 is formed as a lower inclined surface 147 which inclines downward and laterally outward from the midway portion of the projection guide groove 139 in the up-and-down direction (in other words, inclines with respect to the pivot plane including the pivoting direction of the grip 103 and the axial plane including the axial direction (width direction) orthogonal to the pivot plane), as shown in FIGS. 15 and 18.

The front portion 138 is provided with a lever support portion 149 below the projection guide groove 139, as shown in FIG. 16. A detection lever 148 (see FIG. 13) interlocking with the detection gear 88 is pivotably supported by the lever support portion 149.

In the front portion 138, in front of the lever support portion 149, a light passing boss 150 which is formed in a cylindrical shape and protrudes laterally outward is formed. This light passing boss 150 is opposed to the detection window 46 in the width direction in the state where the developer cartridge 27 is attached in the drum unit 26.

(1-2) Center Frame

The center frame 135 is formed of a resin material and formed in a flat plate shape that extends in the width direction, as shown in FIGS. 12 and 19. The center frame 135 supports the scorotron charger 30 and the cleaning brush 31 (see FIG. 2) as described above. The upper end portion of the center frame 135 is provided with a support roller 156 for guiding the attaching and detaching of the developer cartridge 27 on each of the both lateral end portions thereof.

(2) Front Beam

The front beam 131 is molded integrally of a resin material, is arranged on the front side of the four drum subunits 28 which are arranged in parallel along the anteroposterior direction, and extends between the pair of side plates 133, as shown in FIGS. 12 and 19.

This front beam 131 includes a front-side grasp portion 157 attached in the center portion in the width direction, and a support shaft 158 rotatably supporting the front-side grasp portion 157.

The support shaft 158 is disposed so as to extend through the front beam 131 along the width direction, and is supported by the front beam 131.

The front-side grasp portion 157 is formed in a generally U-shape with each distal edge thereof pivotably supported by the support shaft 158 at the center in the width direction, and provided so as to be pivotable between a storage position (refer to FIG. 13) where the front-side grasp portion 157 stands along the front beam 131 and an operative position (refer to FIG. 20) where the front-side grasp portion 157 inclines to the front side of the front beam 131.

(3) Rear Beam

The rear beam 132 is molded integrally of a resin material, is disposed on the rear side of the four drum subunits 28 which are arranged in parallel along the anteroposterior direction, and extends between the pair of side plates 133.

This rear beam 132 is formed in a generally flat-bottomed U-shape with the rear side thereof opened, and integrally includes a back-side grasp portion 159 at the center thereof in the width direction.

The back-side grasp portion 159 is formed in a generally U-shape as seen from the rear, and each distal edge thereof is provided so as to be coupled with the rear beam 132, inclines from the lower rear side to the upper front side, and protrudes obliquely upward from the rear beam 132.

(4) Side Plate

Each side plate 133 is formed of a material which is more rigid than the resin material which forms each drum subunit 28, the front beam 131 and the rear beam 132, such as a metal or a fiber reinforced resin, and preferably, formed of a steel plate.

As shown in FIG. 13, each side plate 133 is formed in an elongated rectangular shape as seen from the side extending in the anteroposterior direction. With respect to the front beam 131, the four drum subunits 28 and the rear beam 132 which are all disposed in parallel in the anteroposterior direction, each side plate 133 is formed so that the front end portion thereof is opposed and fixed to the front beam 131 and the rear end portion thereof is opposed and fixed to the rear beam 132.

The rear end portion of each side plate 133 is formed with a notched portion 160 which is cut away from the rear end edge thereof in a generally U-shape as seen from the side. The notched portion 160 is fitted to a positioning shaft (not shown) provided in the main body casing 2 in the state where the drum unit 26 is attached in the main body casing 2, thereby positioning the drum unit 26 with respect to the main body casing 2.

The upper end portion of each side plate 133 is formed with four light passing holes 161 for receiving the corresponding light passing bosses 150 of each drum subunit 28. Each light passing hole 161 is fitted to the light passing boss 150 so that the light passing boss 150 is exposed laterally outward, thereby restricting the pivot of the drum subunit 28 with respect to the side plate 133 around the drum shaft 33.

The lower end portion of each side plate 133 is formed with shaft holes 162 through which the respective axial end portions of the drum shafts 33 are inserted.

The left side plate 133 is formed with coupling outer insertion holes 163 which is opposed to the coupling gear 87 of each developer cartridge 27 in the width direction and corresponds to each coupling gear 87.

On the left side plate 133, in back of each light passing holes 161, a lever insertion hole 164 is formed. The lever insertion hole 164 is opposed to the lever support portion 149 of the left side frame 134 in the width direction, and exposes one end portion of the detection lever 148 laterally outward.

The detection lever 148 exposed from the lever insertion hole 164 pivots along with the rotation of the detection gear 88. A detection sensor (not shown) provided in the main body casing 2 determines whether the developer cartridge 27 is old or new based on whether the detection lever 148 is detected or not.

4. Attaching and Detaching of Developer Cartridge to and from Drum Unit (1) Attaching of Developer Cartridge to Drum Unit To attach each developer cartridge 27 to the drum unit 26, for example, the grip 103 is held by inserting fingers into the grasp hole 115 of the grip 103 of the developer cartridge 27 for the corresponding color. At this time, the grip 103 is pivoted in the upward and forward direction and located at the spaced position.

Next, the held developer cartridge 27 is attached to the corresponding drum subunit 28 from above the drum unit 26, as shown in FIG. 19.

More specifically, the collar member 85 that covers each of the both axial end portions of the developing roller shaft 51 of the developer cartridge 27 is inserted in the cartridge guide groove 136 of each side frame 134 of the corresponding drum subunit 28. The developer cartridge 27 is then pushed obliquely downwardly rearward to the drum subunit 28 along the cartridge guide groove 136.

When the developing roller 39 comes into contact with the photosensitive drum 29, further pushing of the developer cartridge 27 is restricted. Thereafter, the developer cartridge 27 inclines by its own weight toward the direction toward which the upper end portion thereof leans against the center frame 135 located in the front of it with the developing roller shaft 51 as the center, and each positioning projection 92 of the developer frame 36 abuts against and is supported by the supporting roller 156 of the center frame 135, which allows the developer cartridge 27 to be positioned with respect to the drum subunit 28 to attach the developer cartridge 27 to the drum subunit 28.

Next, the grip 103 is pivoted by keeping holding the grip 103 or releasing the hand and allowing to move by its own weight in the downward and forward direction (referred to hereinafter as a pressing direction) which intersects with the attaching and detaching direction of the developer cartridge 27 to and from the drum subunit 28, each fitting projection 104 of the grip 103 is brought into abutment against the upper V-shape portion 144 in the front portion 138 of the corresponding side frame 134, as shown in FIG. 20. Accordingly, the pivot of the grip 103 in the downward and forward direction is temporarily restricted.

Afterwards, in case that the grip 103 is held and pivoted in the pressing direction, each fitting projection 104 of the grip 103 is guided in the projection guide groove 139 (see the dotted line shown in FIG. 16) while the rear-side inclined surface 118 thereof is sliding on the upper inclined surface 146. At this time, each fitting projection 104 moves inward in the width direction along the inclining direction of the upper inclined surface 146, so that the projection support plate 116 provided with each fitting projection 104 deflects inward in the width direction in accordance with the movement of each fitting projection 104.

When the grip 103 further pivots in the pressing direction, each fitting projection 104 passes the projection guide groove 139 while sliding in the projection guide groove 139 and the front-side inclined surface 117 thereof is opposed to the lower inclined surface 147.

When the grip 103 further pivots in the pressing direction, each fitting projection 104 of the grip 103 is guided in the fitting hole 140 while the front-side inclined surface 117 thereof slides on each lower inclined surface 147. At this time, each fitting projection 104 moves laterally outward along the inclining direction of the lower inclined surface 147, so that the projection support plate 116 provided with each fitting projection 104 returns laterally outside in accordance with the movement of each fitting projection 104.

Afterwards, each fitting projection 104 led inside the fitting hole 140 fits and is fixed to the fitting hole 140, as shown in FIG. 21.

Moreover, as describe above, when the grip 103 is pivoted in the pressing direction, each recess 121 of the grip 103 comes into contact with the abutting member 107. The pressing force generated by the pivot is then transmitted from each recess 121 to the abutting member 107. When each abutting member 107 is pressed, each spring 102 presses the developer frame 36 toward the downstream side in the attaching direction (hereinafter referred to simply as an attaching direction) of the developer cartridge 27 to the drum subunit 28. Then, the developing roller 39 is pressed toward the photosensitive drum 29 on the downstream side in the attaching direction.

Since the pressing state of the grip 103 to each abutting member 107 is maintained when each fitting projection 104 is fixed in the fitting hole 140, the pressing state of the developing roller 39 to the photosensitive drum 29 is maintained by the pressing force of each spring 102.

In the pressing state described above, even when the developer cartridge 27 is pulled out from the drum subunit 28 toward the downstream side in the detaching direction of the developer cartridge 27 from the drum subunit 28 (hereinafter referred to simply as a detaching direction), that is, in obliquely upwardly forward direction, the upper front end face 141 and the upper rear end face 142 of each fitting hole 140 and the front end face 119 and the rear end face 120 of each fitting projection 104 are respectively brought into contact in the direction orthogonal to their opposed direction, and thus the intervention thereof prevents the developer cartridge 27 from being detached from the drum subunit 28.

(2) Detaching of Developer Cartridge from Drum Unit

On the other hand, to detach the developer cartridge 27 from the drum subunit 28, first, the grip 103 is held and pivoted to the upward and forward direction (referred to hereinafter as a pressure releasing direction). This releases the fixing of each fitting projection 104 to the fitting hole 140 and guides each fitting projection 104 of the grip 103 to the projection guide groove 139 while each front-side inclined surface 117 thereof is sliding on the lower inclined surface 147. At this time, each fitting projection 104 moves inward in the width direction along the inclining direction of each lower inclined surface 147, the projection support plate 116 provided with each fitting projection 104 deflects inward in the width direction in accordance with the movement of each fitting projection 104.

When the grip 103 further pivots in the pressure releasing direction, each fitting projection 104 passes the projection guide groove 139 while sliding in the projection guide groove 139, and the rear-side inclined surface 118 thereof is opposed to each upper inclined surface 146.

When the grip 103 further pivots in the pressure releasing direction, each fitting projection 104 of the grip 103 is guided to above the upper V-shape portion 144 while the rear-side inclined surface 118 thereof slides on each upper inclined surface 146. At this time, each fitting projection 104 moves laterally outward along the inclining direction of the upper inclined surface 146, so that the projection support plate 116 provided with each fitting projection 104 returns laterally outward in accordance with the movement of each fitting projection 104.

Moreover, as describe above, when the grip 103 is pivoted in the pressure releasing direction, the fitting of each fitting projection 104 to the fitting hole 140 is released, whereby each recess 121 of the grip 103 is spaced apart from the abutting member 107 and the pressing of each spring 102 on the developing roller 39 is released. The pressing of the developing roller 39 on the photosensitive drum 29 is then released.

Afterwards, when the developer cartridge 27 is pulled out toward the downstream side in the detaching direction while the grip 103 is held, the collar member 85 that covers each of the both axial end portions of the developing roller shaft 51 of the developer cartridge 27 is lifted obliquely upwardly forward along each cartridge guide groove 136 of the drum subunit 28, whereby the developer cartridge 27 is detached from the drum subunit 28.

5. Operations and Effects of the Embodiment (1) In such a drum unit 26, the developer cartridge 27 is attached to the drum subunit 28 and the grip 103 is pivoted in the pressing direction to fix the fitting projection 104 to the fitting hole 140. This fixing allows the grip 103 to press the abutting member 107, and in turn, the spring 102 is pressed toward the developing roller 39, and at the same time, the pressing state of the grip 103 to the abutting member 107 and the spring 102 is maintained. Accordingly, the developing roller 39 is constantly pressed by the photosensitive drum 29 with a uniform pressing force.

Moreover, since the spring 102 is provided in the developer cartridge 27, the spring 102 can be discarded together with the developer cartridge 27 and replaced by a new spring 102 when the developer cartridge 27 reaches the end of the service life due to the consumption of the toner. Therefore, effective pressing force can be constantly secured without leaving the spring 102 which is deteriorated with time. Consequently, the pressing force of the developing roller 39 to the photosensitive drum 29 can be stabilized and thus the stable development can be achieved.

In addition, in a case where the specifications of the toner and the developing roller 39 are changed, the most appropriate spring 102 can be disposed since the spring 102 is provided in the developer cartridge 27.

(2) In this developer cartridge 27, when the grip 103 is pivoted in the pressing direction in the attachment/detachment operating portion 101, the fitting projection 104 is fixed to the fitting hole 140 and the abutting member 107 and the spring 102 are pressed by the grip 103. Further, along with the movement of the grip 103 in the pressure releasing direction, the fixing of the fitting projection 104 to the fitting hole 140 is released and the pressing on the abutting member 107 and the spring 102 by the grip 103 is released. Therefore, with this simple structure, the grip 103 can press the abutting member 107 and the spring 102 or release the pressing on the abutting member 107 and the spring 102.

(3) In the fitting projection 104, the front end portion thereof is formed with the front-side inclined surface 117 and the rear end portion thereof is formed with the rear-side inclined surface 118. Therefore, when the fitting projection104 is fitted in the fitting hole 140 or this fitting is released, more specifically, when the fitting projection 104 enters into or separates from the projection guide groove 139, the fitting projection 104 can reliably move with respect to the projection guide groove 139 smoothly, whereby an improved operability can be achieved.

(4) In this drum unit 26, when the developer cartridge 27 is pulled from the drum subunit 28 toward the downstream side of the detaching direction, that is, in the obliquely upwardly forward direction, in the state where the fitting projection 104 is fixed to the fitting hole 140 (in the pressing state as described above), the upper front end face 141 and the upper rear end face 142 of each fitting hole 140 and the front end face 119 and the rear end face 120 of each fitting projection 104 are respectively brought into contact in the direction orthogonal to their opposed direction, and thus this abutment prevents the developer cartridge 27 from being detached from the drum subunit 28 in the state where the fitting projection 104 is fixed to the fitting hole 140. Therefore, the operational error can be prevented and an improved durability of the apparatus can be achieved.

(5) In addition, the front end face 119 and the rear end face 120 of the fitting projection 104 each having a different angle from the other respectively abut against the upper front end face 141 and the upper rear end face 142 each having a different angle from the other of the fitting hole 140. Therefore, the fitting projection 104 can be reliably positioned with respect to the fitting hole 140. As a result, the pressing force of the developing roller 39 to the photosensitive drum 29 can be further stabilized.

(6) Moreover, in the drum subunit 28, since the passage portion 143 of the fitting projection 104 is formed with the projection guide groove 139, a smooth and reliable movement of the fitting projection 104 can be secured, whereby the operation can further be improved.

(7) In the projection guide groove 139, the upper end portion thereof is formed with the upper inclined surface 146 and the lower end portion thereof is formed with the lower inclined surface 147. Therefore, when the fitting projection 104 is fixed to the fitting hole 140 or the fixing is released, more specifically, when the fitting projection 104 enters into or separates from the projection guide groove 139, the fitting projection 104 can smoothly move with respect to the projection guide groove 139. This can achieve further improved operability, in cooperation with the front-side inclined surface 117 and the rear-side inclined surface 118 of the fitting projection 104 described above.

(8) The developer cartridge 27 can be attached and detached by holding the grip 103 since the grip 103 also serves as the pressing member for pressing the abutting member 107 and the spring 102. The number of components can also be reduced compared with that in the case where the grip 103 and a pressing member are separately provided. As a result, the operability can be improved and the number of components can be reduced.

(9) In this developer cartridge 27, each recess 121 provided in the lower portion of the grip 103 is disposed inward of the upper wall 84 in the width direction and at an opposed position to the abutting member 107, the external pressing force can be securely received, which in turn can be stably transmitted to the abutting member 107 and the spring 102.

(10) In addition, the abutting member 107 and the spring 102 are provided in the spring receiving cylindrical portion 105 disposed on each of the both lateral end portions in the front end portion of the upper wall 84. Accordingly, the pressing force from the grip 103 can be received uniformly in the width direction and the pressing force can then be applied uniformly on the developing roller 39 in the axial direction. The developing roller 39 is thus prevented from making partial contact with the photosensitive drum 29. The partial contact means that one end portion of the developing roller 39 in the axial direction is pressed relatively strongly to the photosensitive drum 29 and the other end portion is pressed relatively weakly to the photosensitive drum 29. The developing roller 39 can thus press the photosensitive drum 29 in the axial direction in a balanced manner. As a result, the pressing force from the developing roller 39 to the photosensitive drum 29 can be further stabilized.

SECOND EMBODIMENT

Figure 22:
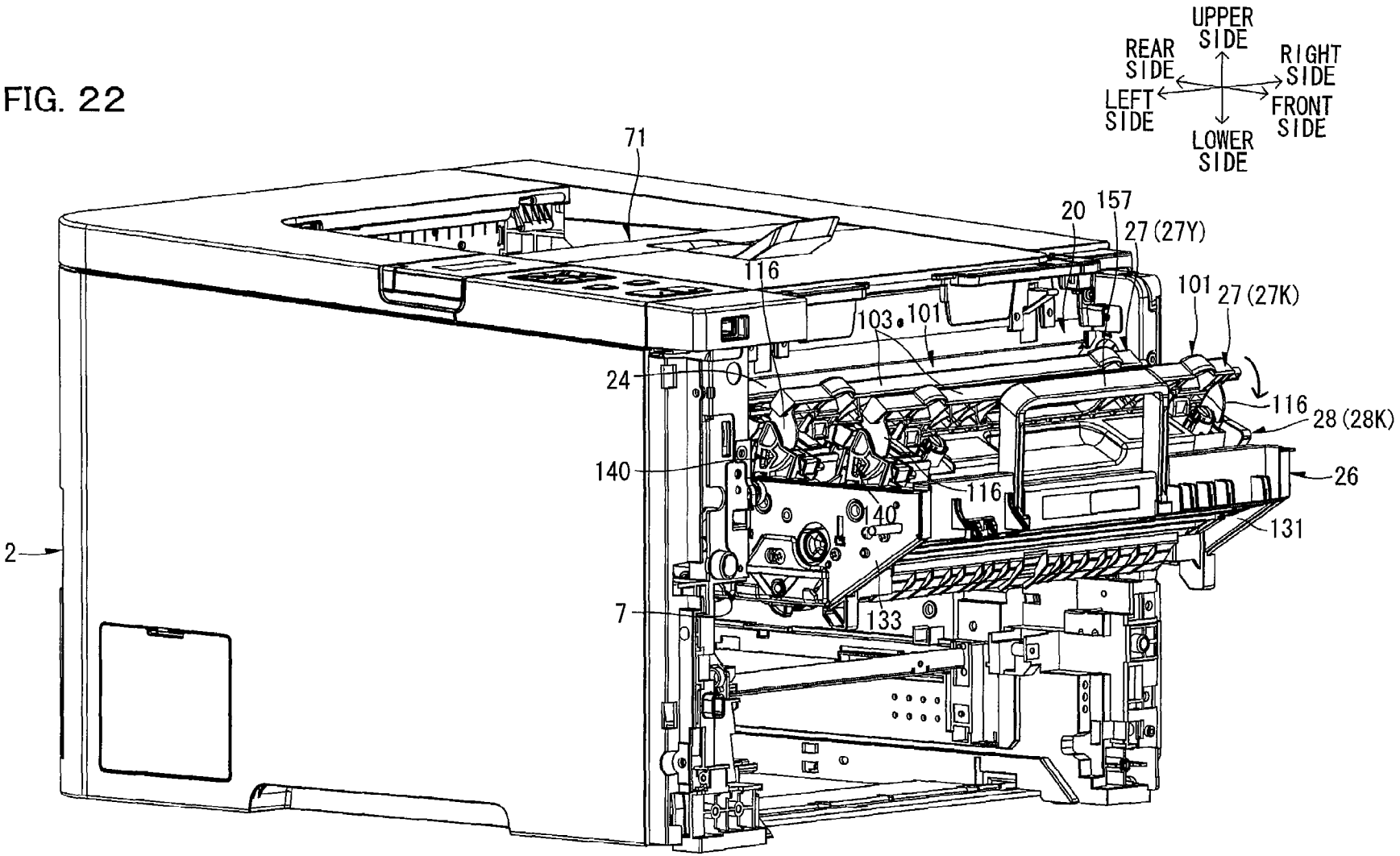
FIG. 22 is a perspective view of the drum unit in a state where the drum unit is being attached to the main body casing as seen from the left front.

In the description above, the grip 103 is held and pivoted in the pressing direction to fix the fitting projection 104 to the fitting hole 140 when the developer cartridge 27 is attached to the drum subunit 28. However, the grip 103 can be brought into abutment against the front wall surface of the scanner casing 24 in the drum receiving space 7 in the main body casing 2 to pivot the grip 103 in the pressing direction when the drum unit 26 is attached to the drum receiving space 7 of the main body casing 2, as shown in FIG. 22, for example, without pivoting the grip 103 in the pressing direction when the developer cartridge 27 is attached to the drum subunit 28.

More specifically, after the four developer cartridge 27 are attached to the corresponding drum subunits 28, the front-side grasp portion 157 and the rear-side grasp portion 159 of the drum unit 26 are held by hands, respectively. Then the drum unit 26 is entered into the drum receiving space 7 which has been opened by forward inclining of the front cover 8 from the front side to the rear side. Then, along with the entrance of the drum unit 26 into the drum receiving space 7, the grip 103 of each developer cartridge 27 is sequentially brought into abutment against the front wall surface of the scanner casing 24 in the drum receiving space 7 and pressed by the front wall surface, to be pivoted to the pressing direction, whereby the fitting projection 104 is fixed to the fitting hole 140.

Since the fitting projection 104 can be fixed to the fitting hole 140 in such a manner, the grip 103 certainly pivots in the pressing direction when the drum unit 26 is entered into the drum receiving space 7 of the main body casing 2, even in the case where the grip 103 is failed to be pivoted in the pressing direction when the developer cartridge 27 is attached to the drum subunit 28, whereby the fitting projection 104 can reliably be fixed to the fitting hole 140.

THIRD EMBODIMENT

Figure 23:
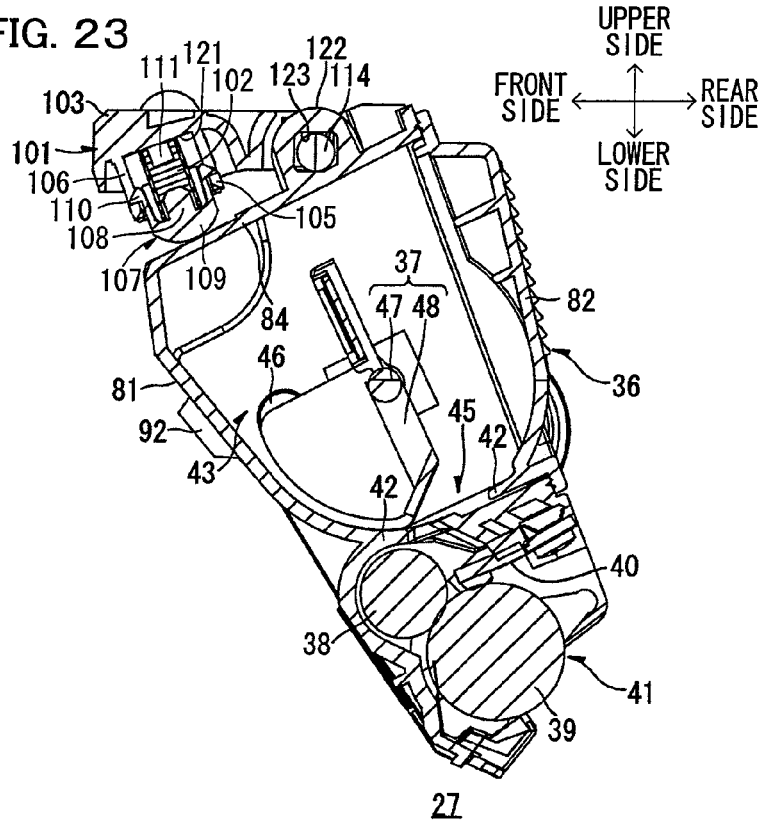
FIG. 23 is a sectional view of a developer cartridge according to a third embodiment.

Further, in the above description, as shown in FIG. 10, the spring receiving cylindrical portion 105 is provided in the upper wall 84, and the spring 102 and the abutting member 107 are disposed in the spring receiving cylindrical portion 105. At the same time, the grip 103 is formed with the recess 121 which receives the abutting member 107. However, as shown in FIG. 23, the spring receiving cylindrical portion 105 may be provided in the grip 103, and the spring 102 and the abutting member 107 are disposed in the spring receiving cylindrical portion 105 to bring the abutting member 107 into abutment against the upper wall 84. In FIG. 23, the same components as in the above description will be provided with the same reference numeral and the descriptions thereof will be omitted.

FOURTH EMBODIMENT

Figure 24:
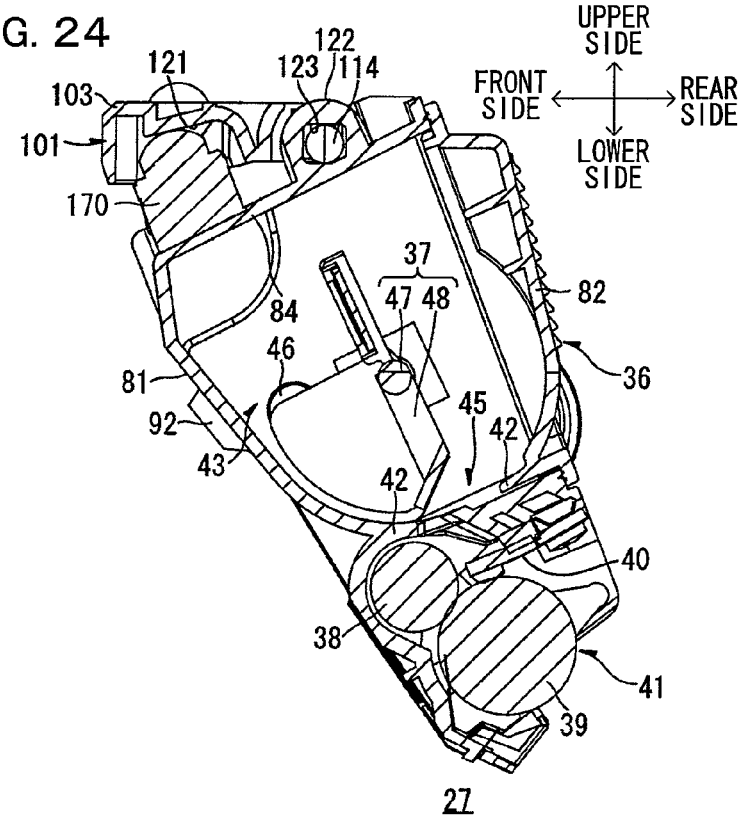
FIG. 24 is a sectional view of a developer cartridge according to a fourth embodiment.
Figure 25:
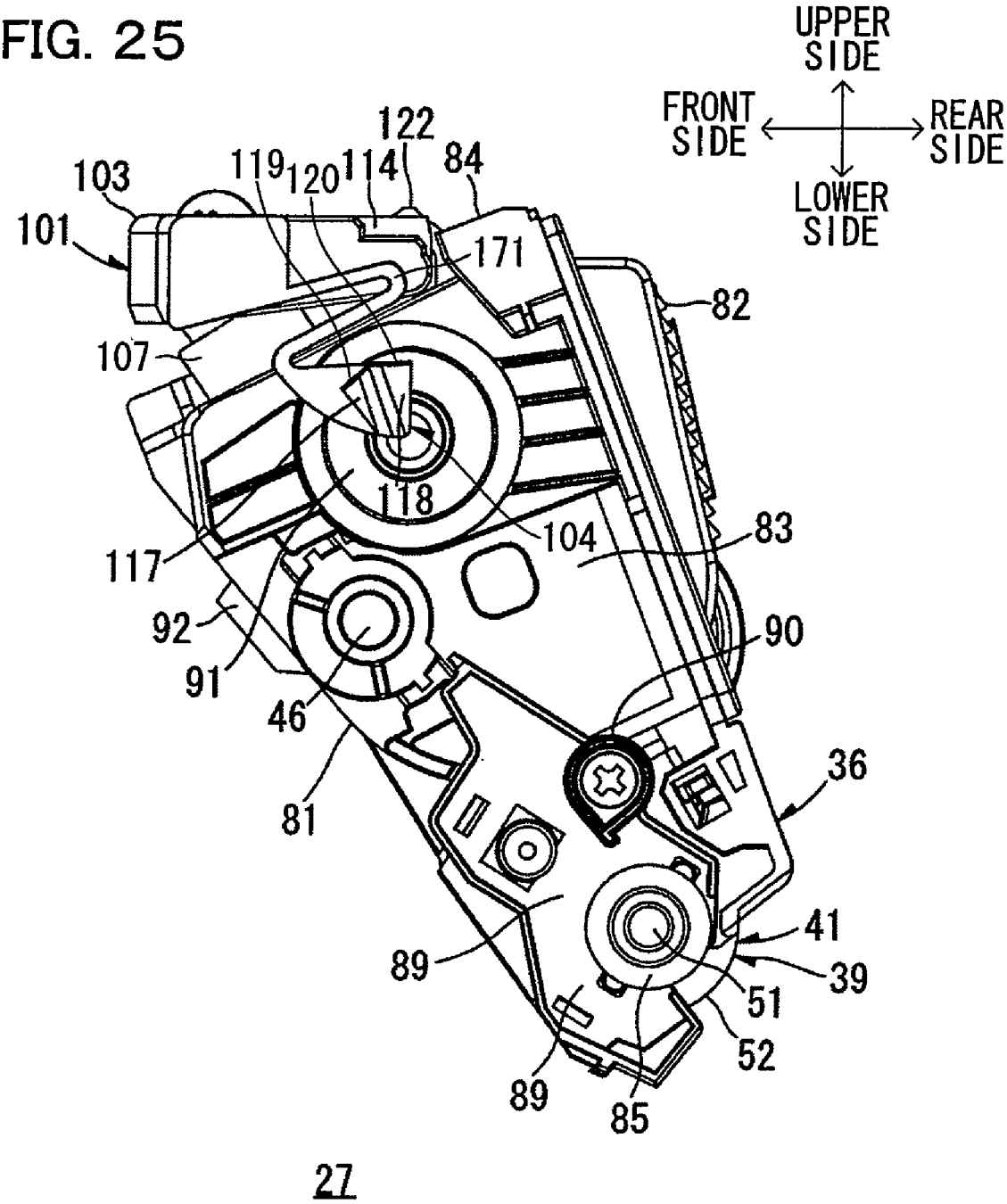
FIG. 25 is a right side view of the developer cartridge according to the fourth embodiment.

Further, the spring 102, the abutting member 107 and the spring receiving cylindrical portion 105 may not be provided. Alternatively, as shown in FIGS. 24 and 25, a resin spring portion 171 as an example of the elastic member may be provided in place of the projection support plate 116. In FIGS. 24 and 25, the same components as in the above description will be provided with the same reference numeral and the descriptions thereof will be omitted.

That is, in FIG. 24, the upper wall 84 is provided with a stopper 170 formed of resin, in place of the spring receiving cylindrical portion 105. The stopper 170 is disposed at the same position as that of the spring receiving cylindrical portion 105, and has the same height as the height from the upper wall 84 to the upper end portion of the abutting member 107 in the state of not being abutted by the grip 103.

On the other hand, as shown in FIG. 25, the grip 103 is provided with the resin spring portions 171 which respectively bend downward from the both lateral end edges of the grip 103.

The resin spring portion 171 is made of resin and formed integrally with the grip 103 and the fitting projection 104. The resin spring portion 171 has a generally V-shape as seen from the side, and is flexible in the up-and-down direction. The fitting projection 104 is provided on the lower end portion of the resin spring portion 171.

Accordingly, when the grip 103 is pivoted in the pressing direction, the recess 121 of the grip 103 presses the stopper 170. Further pivoting of the grip 103 is restricted when the grip 103 abuts against the stopper 170. At the same time, the fitting projection 104 is fitted in and engaged with the fitting hole 140, and as a result, a pressing state of the grip 103 against the stopper 170 is retained. At this time, since the resin spring portion 171 is expanded between the grip 103 and the fitting projection 104, the fitting projection 104 urges upward the upper rear end face 142 of the fitting hole 140. Then, the developer cartridge 27 is pressed downward by the resulting reaction force, and as a result, the developing roller 39 is pressed against the photosensitive drum 29.

According to this embodiment, the spring 102, the abutting member 107 and the spring receiving cylindrical portion 105 can be eliminated only by forming the resin spring portions 171 integrally with the grip 103 and the fitting projection 104, so that the number of components can be reduced and the construction can be simplified.

FIFTH EMBODIMENT

In the above description, although a tandem type color laser printer has been illustrated as an example of an image forming apparatus, an image forming apparatus equipped with the photosensitive unit and the developer cartridge according to the present invention is not limited thereto, and, the present invention may include, for example, an intermediate transfer type color laser printer which temporarily transfers the developing agent image of each color from each photosensitive body to an intermediate transfer body and then transfers the images onto a recording medium in a collective manner, or a black and white laser printer.

The embodiments described above are illustrative and explanatory of the invention. The foregoing disclosure is not intended to be precisely followed to limit the present invention. Various modifications and alterations are possible in light of the foregoing description, and may be obtained by implementing the invention. The present embodiments are selected and described for explaining the practical application schemes of the present invention which allow those skilled in the art to utilize the present invention in various embodiments and various alterations suitable for anticipated specific use. The scope of the present invention is to be defined by the appended claims and their equivalents.

What is claimed is:

1. A photosensitive unit comprising:

a developer cartridge comprising a developing agent carrier carrying a developing agent and a casing supporting the developing agent carrier and accommodating the developing agent;

a photosensitive body disposed so that the developing agent carrier is brought into contact therewith by pressing and developed with an electrostatic latent image by the developing agent fed from the developer agent carrier; and a cartridge attaching portion to which the developer cartridge is detachably attached, wherein the casing comprises an elastic member, a pressing member for pressing the elastic member toward the developing agent carrier so that the developing agent carrier is pressed toward the photosensitive body, and a fitting member provided on the pressing member, and the cartridge attaching portion comprises a fit portion which is fitted with the fitting member so that the pressing member presses the elastic member toward the developing agent carrier for maintaining a pressing state of the pressing member to the elastic member.

2. The photosensitive unit according to claim 1, wherein the pressing member is configured to move along a pressing direction for pressing the elastic member toward the developing agent carrier and a pressing release direction for releasing the pressing of the elastic member to the developing agent carrier, the fitting member is fitted to the fit portion by a movement of the pressing member toward the pressing direction and released from the fit portion by a movement of the pressing member toward the pressing release direction, and the elastic member is disposed on a downstream side of the pressing direction with respect to the pressing member, and pressed by the pressing member through fitting the fitting member to the fit portion and released from the pressing by the pressing member through releasing the fitting member from the fit portion.

3. The photosensitive unit according to claim 1, wherein the fitting member is formed with an inclined surface which inclines to a plane including movement directions of the pressing member and a plane orthogonal to the plane, on at least either one of end portions in the movement directions.

4. The photosensitive unit according to claim 1, wherein the developer cartridge is detachably attached to the cartridge attaching portion in a direction intersecting with movement directions of the pressing member, and opposed surfaces of the fitting member and the fit portion which are opposed to each other are orthogonal to an opposed direction thereof in a detaching direction for detaching the developer cartridge from the cartridge attaching portion.

5. The photosensitive unit according to claim 4, wherein the opposed surface of the fitting member and the opposed surface of the fit portion respectively comprise a plurality of planes having different angles.

6. The photosensitive unit according to claim 1, wherein the cartridge attaching portion comprises a passage portion which the fitting member traverses when the fitting member is fitted to the fit portion or is released from the fit portion, and the passage portion is formed with a guide groove guiding passage of the fitting member and formed along movement directions of the pressing member.

7. The photosensitive unit according to claim 6, wherein the guide groove is formed with an inclined surface which is inclined to a plane including the movement directions and a plane orthogonal to the plane on at least either one of end portions thereof in the movement directions.

8. The photosensitive unit according to claim 1, wherein the pressing member also serves as a grip which is held when the developer cartridge is attached or detached.

9. The photosensitive unit according to claim 1, wherein the developing agent carrier is provided on one end portion of the casing, the elastic member is provided on the other end portion of the casing which is opposite to the one end portion, and the pressing member is provided on the other end portion so as to be pivotable around a pivoting axis which extends in a direction identical with an axial direction of the developing agent carrier, and brought into contact with the elastic member by pivoting around the pivoting axis.

10. The photosensitive unit according to claim 9, wherein the pressing member is provided inward in the axial direction in the casing and comprises a transmitting portion brought into abutment against the elastic member for transmitting an external pressing force to the elastic member.

11. The photosensitive unit according to claim 9, wherein two elastic members are provided in a spaced relation in the axial direction of the developing agent carrier.

12. A developer cartridge detachably attachable to a photosensitive unit having a photosensitive body, comprising:

a developing agent carrier for carrying a developing agent which is fed to the photosensitive body;

a casing supporting the developing agent carrier and accommodating a developing agent;

an elastic member provided in the casing;

a pressing member provided in the casing for pressing the elastic member toward the developing agent carrier so that the developing agent carrier is pressed toward the photosensitive body; and a fitting member provided on the pressing member, fitted to the photosensitive unit so that the pressing member presses the elastic member toward the developing agent carrier for maintaining a pressing state of the pressing member to the elastic member.

13. The developer cartridge according to claim 12, wherein the pressing member is configured to move along a pressing direction for pressing the elastic member toward the developing agent carrier and a pressing release direction for releasing pressing of the elastic member to the developer agent carrier, the fitting member is moved in a direction where the fitting member is fitted to the photosensitive unit by movement of the pressing member in the pressing direction and moved in a direction where the fitting member is released from the photosensitive unit by a movement of the pressing member in the pressing release direction, and the elastic member is disposed on a downstream side in the pressing direction with respect to the pressing member, pressed by the pressing member through movement of the fitting member to the photosensitive unit in the fitting direction and released from the pressing member through movement of the fitting member from the photosensitive unit in a fitting releasing direction.

14. The developer cartridge according to claim 12, wherein the fitting member is formed with an inclined surface inclined with respect to a plane including movement directions of the pressing member and a plane orthogonal to the plane on at least either one of end portions in the movement directions.

15. The developer cartridge according to claim 12, wherein the fitting member has an end face in a detaching direction of the developer cartridge from the photosensitive unit formed in a flat shape along a direction parallel with an axial direction of the developing agent carrier.

16. The developer cartridge according to claim 15, wherein the end face comprises a plurality of planes each having a different angle.

17. The developer cartridge according to claim 12, wherein the pressing member also serves as a grip which is held when the developer cartridge is attached or detached.

18. The developer cartridge according to claim 12, wherein the developing agent carrier is provided on one end portion of the casing, the elastic member is provided on the other end portion which is opposite to the one end portion of the casing, and the pressing member is provided on the other end portion so as to be pivotable around a pivoting axis which extends in a direction identical with an axial direction of the developing agent carrier, and is brought into contact with the elastic member by pivoting around the pivoting axis.

19. The developer cartridge according to claim 18, wherein the pressing member is provided inward in the axial direction in the casing and comprises a transmitting portion brought into abutment against the elastic member for transmitting an external pressing force to the elastic member.

20. The developer cartridge according to claim 18, wherein two elastic members are provided in a spaced relation in the axial direction of the developing agent carrier.

21. A developer cartridge comprising:

a casing for accommodating a developing agent;

a developing agent carrier provided on one end portion of the casing for carrying the developing agent;

an elastic member provided on the other end portion which is opposite to the one end portion of the casing;

a pressing member provided on the other end portion of the casing for pressing the elastic member toward the developing agent carrier; and a fitting member provided on the pressing member so as to protrude outward in an axial direction of the developing agent carrier and configured to be fitted to another member to maintain a pressing state of the pressing member to the elastic member.

22. The developer cartridge according to claim 21, wherein the pressing member is configured to move along a pressing direction for pressing the elastic member toward the developing agent carrier and a pressing release direction for releasing pressing of the elastic member to the developing agent carrier, and the elastic member is disposed on a downstream side in the pressing direction with respect to the pressing member, and pressed by the pressing member through movement of the pressing member toward the pressing direction and released from pressing by the pressing member through movement of the pressing member toward the pressing release direction.

23. The developer cartridge according to claim 21, wherein the fitting member is formed with an inclined surface inclined with respect to a plane including movement directions of the pressing member and a plane orthogonal to the plane on at least either one of end portions in the movement directions.

24. The developer cartridge according to claim 21, wherein the fitting member has at least one portion of an end face in a direction intersecting with movement directions of the pressing member formed in a flat shape along a direction which is parallel to the axial direction of the developing agent carrier.

25. The developer cartridge according to claim 24, wherein the end face has a plurality of planes each having a different angle.

26. A developer cartridge comprising:

a developing roller carrying a developing agent;

a developer frame accommodating the developing agent, formed with an opening on one end side, and rotatably supporting the developing roller in the vicinity of the opening;

an elastic member provided on other end side in the developer frame;

a grip provided to be pivotable between a position where the elastic member is pressed and a position where the elastic member is not pressed with a portion of the developer frame as a spindle, wherein the grip comprises a pressing plate which is configured to be opposed to the other end side of the developer frame, a supporting plate extending from both end edges of the pressing plate in a longitudinal direction of the developing roller toward the one end side, and a projection protruding from an outside surface in a longitudinal direction of the developing roller in the vicinity of the one end side of the supporting plate.

27. The developer cartridge according to claim 26, wherein the supporting plate is formed in a generally fan-shape tapering from the other end side to the one end side.

28. The developer cartridge according to claim 26, wherein the projection is formed in a generally truncated three sided pyramid shape as seen from the side tapering from the other end side to the one end side.

29. The developer cartridge according to claim 26, wherein the projection is formed with an inclined surface inclined to a plane including a movement direction and a plane orthogonal to the plane at least either one of end portions in the movement direction of the grip.

30. The developer cartridge according to claim 29, wherein the projection is provided with an end face in which at least one portion of the end surface in a direction intersecting with the movement direction is formed flat along a direction in parallel with an axial direction of the developing roller, the end surface comprises a plurality of planes with different angles.

31. A developer cartridge comprising:

a developing roller carrying a developing agent;

a developer frame accommodating the developing agent, formed with an opening on one end side, and rotatably supporting the developing roller in the vicinity of the opening; and a grip provided on other end side in the developer frame, wherein the grip comprises a pressing plate which is configured to be opposed to the other end side of the developer frame, a supporting plate extending from both end edges of the pressing plate in a longitudinal direction of the developing roller toward the one end side, a projection protruding from an outside surface in a longitudinal direction of the developing roller in the vicinity of the one end side of the supporting plate, and an elastic member formed in the pressing plate and configured to be opposed to the other end side of the developer frame, and the grip is configured to be pivotable between a position where the elastic member presses the other end side of the developer frame and a position where the elastic member does not press the other end side of the developer frame with a portion of the developer frame as a spindle.

32. A developer cartridge comprising:

a developing roller carrying a developing agent;

a developer frame accommodating the developing agent, formed with an opening on one end side, and rotatably supporting the developing roller in the vicinity of the opening; and a grip provided on other end side in the developer frame to be pivotable between a position close to the other end side of the developer frame and a position spaced from the other end side of the developer frame with a portion of the developer frame as a spindle, wherein the grip comprises a pressing plate which is configured to be opposed to the other end side of the developer frame, an elastic member extending from both end edges of the pressing plate in a longitudinal direction of the developing roller toward the one end side, and a projection protruding outward in a longitudinal direction of the developing roller in the vicinity of the one end side of the elastic member.

* * * * *